US008421713B2

(12) United States Patent
Yahagi et al.

(10) Patent No.: US 8,421,713 B2
(45) Date of Patent: Apr. 16, 2013

(54) DRIVING METHOD OF PLASMA DISPLAY PANEL

(75) Inventors: Kazuo Yahagi, Chuo (JP); Mitsuhiro Ishizuka, Chuo (JP); Yuya Shiozaki, Chuo (JP); Shunsuke Itakura, Chuo (JP); Kazuhiro Kanai, Chuo (JP); Hajime Homma, Chuo (JP); Yoshichika Sato, Chuo (JP); Hikaru Takahashi, Chuo (JP)

(73) Assignee: Panasonic Corporation, Kadoma-shi, Osaka (JP)

( * ) Notice: Subject to any disclaimer, the term of this patent is extended or adjusted under 35 U.S.C. 154(b) by 0 days.

(21) Appl. No.: 13/448,819

(22) Filed: Apr. 17, 2012

(65) Prior Publication Data

US 2012/0200543 A1 Aug. 9, 2012

Related U.S. Application Data

(62) Division of application No. 12/187,995, filed on Aug. 7, 2008.

(30) Foreign Application Priority Data

Mar. 3, 2008 (JP) ..... 2008-052275

(51) Int. Cl.
*G09G 3/28* (2006.01)

(52) U.S. Cl.
USPC ..... 345/60; 345/67; 345/68

(58) Field of Classification Search ..... 345/60–67
See application file for complete search history.

(56) References Cited

U.S. PATENT DOCUMENTS

| | | | | |
|---|---|---|---|---|
| 5,872,425 | A * | 2/1999 | Shino et al. | 313/582 |
| 6,778,152 | B1 * | 8/2004 | Huang | 345/60 |
| 7,561,151 | B2 * | 7/2009 | Cho et al. | 345/204 |
| 7,834,820 | B2 * | 11/2010 | Ikeda et al. | 345/68 |
| 2001/0045924 | A1 * | 11/2001 | Huang | 345/63 |
| 2005/0116889 | A1 * | 6/2005 | Whang et al. | 345/60 |
| 2005/0248504 | A1 * | 11/2005 | Kim et al. | 345/60 |
| 2006/0164342 | A1 * | 7/2006 | Cho et al. | 345/67 |
| 2006/0267878 | A1 * | 11/2006 | Ikeda et al. | 345/68 |
| 2008/0150835 | A1 * | 6/2008 | Paik et al. | 345/60 |

FOREIGN PATENT DOCUMENTS

| | | |
|---|---|---|
| EP | 1 244 088 | 9/2002 |
| EP | 1 729 277 | 12/2006 |
| EP | 1 887 605 | 2/2008 |
| JP | 2003-297250 | 10/2003 |
| JP | 2006-054160 | 2/2006 |

(Continued)

*Primary Examiner* — Amare Mengistu
*Assistant Examiner* — Sarvesh J Nadkarni
(74) *Attorney, Agent, or Firm* — Drinker Biddle & Reath LLP

(57) ABSTRACT

It is an object to provide a driving method of a plasma display panel, whereby a dark contrast can be improved while suppressing an erroneous discharge. In a resetting step in a first unit display period, while a first reset pulse having a predetermined peak electric potential is applied to one of first row electrodes of row electrode pairs formed in the PDP, a second reset pulse having a peak electric potential smaller than that of the first reset pulse is applied to the other of the first row electrodes. In the resetting step in a second unit display period subsequent to the first unit display period, a second reset pulse is applied to each of the one and the other of the first row electrodes.

18 Claims, 27 Drawing Sheets

GTS1 (FIG. 8) : THE 1ST RESET DISCHARGE EXISTS
GTS2 (FIG. 9) : THERE IS NO 1ST RESET DISCHARGE
GTS3 (FIG. 10) : THERE IS NO 1ST RESET DISCHARGE

FOREIGN PATENT DOCUMENTS

| | | |
|---|---|---|
| JP | 2006-059779 | 3/2006 |
| JP | 2006-154830 | 6/2006 |
| JP | 2009-186915 | 8/2009 |
| KR | 0450179 | 9/2004 |
| KR | 0570970 | 4/2006 |
| KR | 0603371 | 7/2006 |
| WO | WO 2008/018527 | 2/2008 |
| WO | WO 2009/101784 | 8/2009 |

* cited by examiner

V-V CROSS SECTION

W-W CROSS SECTION

FIG. 6

| GRADATION DRIVE | DATA CONVERSION TABLE | | | | | | | | | | | | | | | LIGHT-EMITTING PATTERN | | | | | | | | | | | | | | DISPLAY LUMINANCE |
|---|---|---|---|---|---|---|---|---|---|---|---|---|---|---|---|---|---|---|---|---|---|---|---|---|---|---|---|---|---|---|
| | PDs | GD 1 | 2 | 3 | 4 | 5 | 6 | 7 | 8 | 9 | 10 | 11 | 12 | 13 | 14 | SF 1 | SF 2 | SF 3 | SF 4 | SF 5 | SF 6 | SF 7 | SF 8 | SF 9 | SF 10 | SF 11 | SF 12 | SF 13 | SF 14 | |
| 1ST | 0000 | 0 | 0 | 0 | 0 | 0 | 0 | 0 | 0 | 0 | 0 | 0 | 0 | 0 | 0 | | | | | | | | | | | | | | | 0 |
| 2ND | 0001 | 1 | 0 | 0 | 0 | 0 | 0 | 0 | 0 | 0 | 0 | 0 | 0 | 0 | 0 | □ | | | | | | | | | | | | | | α |
| 3RD | 0010 | 0 | 1 | 1 | 0 | 0 | 0 | 0 | 0 | 0 | 0 | 0 | 0 | 0 | 0 | | ◎ | ● | | | | | | | | | | | | 1 |
| 4TH | 0011 | 1 | 1 | 1 | 0 | 0 | 0 | 0 | 0 | 0 | 0 | 0 | 0 | 0 | 0 | □ | ◎ | ● | | | | | | | | | | | | 1+α |
| 5TH | 0100 | 1 | 1 | 0 | 1 | 0 | 0 | 0 | 0 | 0 | 0 | 0 | 0 | 0 | 0 | □ | ◎ | ○ | ● | | | | | | | | | | | 3+α |
| 6TH | 0101 | 1 | 1 | 0 | 0 | 1 | 0 | 0 | 0 | 0 | 0 | 0 | 0 | 0 | 0 | □ | ◎ | ○ | ○ | ● | | | | | | | | | | 9+α |
| 7TH | 0110 | 1 | 1 | 0 | 0 | 0 | 1 | 0 | 0 | 0 | 0 | 0 | 0 | 0 | 0 | □ | ◎ | ○ | ○ | ○ | ● | | | | | | | | | 17+α |
| 8TH | 0111 | 1 | 1 | 0 | 0 | 0 | 0 | 1 | 0 | 0 | 0 | 0 | 0 | 0 | 0 | □ | ◎ | ○ | ○ | ○ | ○ | ● | | | | | | | | 27+α |
| 9TH | 1000 | 1 | 1 | 0 | 0 | 0 | 0 | 0 | 1 | 0 | 0 | 0 | 0 | 0 | 0 | □ | ◎ | ○ | ○ | ○ | ○ | ○ | ● | | | | | | | 39+α |
| 10TH | 1001 | 1 | 1 | 0 | 0 | 0 | 0 | 0 | 0 | 1 | 0 | 0 | 0 | 0 | 0 | □ | ◎ | ○ | ○ | ○ | ○ | ○ | ○ | ● | | | | | | 55+α |
| 11TH | 1010 | 1 | 1 | 0 | 0 | 0 | 0 | 0 | 0 | 0 | 1 | 0 | 0 | 0 | 0 | □ | ◎ | ○ | ○ | ○ | ○ | ○ | ○ | ○ | ● | | | | | 77+α |
| 12TH | 1011 | 1 | 1 | 0 | 0 | 0 | 0 | 0 | 0 | 0 | 0 | 1 | 0 | 0 | 0 | □ | ◎ | ○ | ○ | ○ | ○ | ○ | ○ | ○ | ○ | ● | | | | 103+α |
| 13TH | 1100 | 1 | 1 | 0 | 0 | 0 | 0 | 0 | 0 | 0 | 0 | 0 | 1 | 0 | 0 | □ | ◎ | ○ | ○ | ○ | ○ | ○ | ○ | ○ | ○ | ○ | ● | | | 133+α |
| 14TH | 1101 | 1 | 1 | 0 | 0 | 0 | 0 | 0 | 0 | 0 | 0 | 0 | 0 | 1 | 0 | □ | ◎ | ○ | ○ | ○ | ○ | ○ | ○ | ○ | ○ | ○ | ○ | ● | | 169+α |
| 15TH | 1110 | 1 | 1 | 0 | 0 | 0 | 0 | 0 | 0 | 0 | 0 | 0 | 0 | 0 | 1 | □ | ◎ | ○ | ○ | ○ | ○ | ○ | ○ | ○ | ○ | ○ | ○ | ○ | ● | 209+α |
| 16TH | 1111 | 1 | 1 | 0 | 0 | 0 | 0 | 0 | 0 | 0 | 0 | 0 | 0 | 0 | 0 | □ | ◎ | ○ | ○ | ○ | ○ | ○ | ○ | ○ | ○ | ○ | ○ | ○ | ○ | 255+α |

α<1

□ : WRITE ADDRESS DISCHARGE + MICRO LIGHT-EMITTING DISCHARGE

◎ : WRITE ADDRESS DISCHARGE + SUSTAIN DISCHARGE LIGHT EMISSION

○ : SUSTAIN DISCHARGE LIGHT EMISSION

● : ERASE ADDRESS DISCHARGE

[1ST DRIVING PULSE APPLYING SEQUENCE GTS1]

[2ND DRIVING PULSE APPLYING SEQUENCE GTS2]

[3RD DRIVING PULSE APPLYING SEQUENCE GTS3]

GTS1 (FIG. 8) : THE 1ST RESET DISCHARGE EXISTS
GTS2 (FIG. 9) : THERE IS NO 1ST RESET DISCHARGE

V-V CROSS SECTION

[1ST DRIVING PULSE APPLYING SEQUENCE GTS1]

GTS1 (FIG. 8) : THE 1ST RESET DISCHARGE EXISTS
GTS2 (FIG. 9) : THERE IS NO 1ST RESET DISCHARGE

DRIVING METHOD OF PLASMA DISPLAY PANEL

This is a divisional application of copending U.S. patent application Ser. No. 12/187,995, filed on Aug. 7, 2008, which is incorporated by reference herein in its entirety.

BACKGROUND OF THE INVENTION

1. Field of the Invention

The invention relates to a driving method of a plasma display panel.

2. Description of the Related Arts

At present, a plasma display panel (hereinbelow, abbreviated to PDP) of an AC type (alternating current discharging type) has been manufactured as a thin type display apparatus. In the PDP, two substrates, that is, a front transparent substrate and a rear substrate are arranged so as to face each other through a predetermined gap. A plurality of row electrode pairs extending in the lateral direction of a display screen are formed as pairs on the inner surface of the front transparent substrate (surface which faces the rear substrate) serving as a display plane. Further, a dielectric layer which covers each of the row electrode pairs is formed on the inner surface of the front transparent substrate. A plurality of column electrodes extending in the vertical direction of the display screen are formed on the rear substrate side so as to cross the row electrode pairs. When seen from the display plane side, a discharge cell corresponding to a pixel is formed in a cross portion of the row electrode pair and the column electrode.

To the PDP as mentioned above, a gradation driving using a subfield method is executed so as to obtain a halftone display luminance corresponding to an input video signal.

According to the gradation driving based on the subfield method, a display driving to a video signal of one field is executed in each of a plurality of subfields to each of which the number of times (or period) of light emission to be executed has been allocated. In each subfield, an addressing step and a sustaining step are sequentially executed. In the addressing step, an address discharge is selectively generated between the row electrode and the column electrode in each discharge cell in accordance with an input video signal, thereby forming (or erasing) wall charges of a predetermined amount. In the sustaining step, only the discharge cell in which the wall charges of the predetermined amount have been formed is repetitively discharged and a light-emitting state accompanied by the discharge is maintained. Further, prior to the addressing step, a resetting step is executed in at least the head subfield. In the resetting step, in all discharge cells, a reset discharge is caused between the row electrodes forming the pair, thereby initializing the amount of wall charges remaining in all of the discharge cells.

Since the reset discharge is a relatively strong discharge and does not take part in the contents of an image to be displayed, there is such a problem that the light emission due to the discharge causes a contrast of the image to be deteriorated.

A PDP constructed in such a manner that a magnesium oxide crystal which is excited by irradiation of an electron beam and executes a cathode luminescence light emission having a peak at wavelengths of 200-300 nm is deposited onto the surface of a dielectric layer with which a row electrode pair is covered, thereby shortening a discharge time lag and a driving method of the PDP have, therefore, been disclosed in Japanese Patent Kokai No. 2006-54160. According to the PDP, since a priming effect after the discharge continues for a relatively long time, a weak discharge can be stably caused.

By applying a reset pulse having a pulse waveform whose voltage value reaches gradually a peak voltage value with the elapse of time to the row electrodes of the PDP as mentioned above, the weak reset discharge is caused between the adjacent row electrodes. At this time, since a light emission luminance due to the discharge deteriorates by the weakening of the reset discharge, the contrast of the image can be raised.

If the reset discharge is weakened or an execution frequency of the reset discharge is reduced, however, an amount of priming particles which are formed in the discharge cell decreases and such a problem that it is difficult to cause an addressing discharge in the next addressing step occurs.

SUMMARY OF THE INVENTION

It is an object of the invention to provide a driving method of a plasma display panel which can improve a contrast while suppressing an erroneous discharge.

According to the first aspect of the invention, there is provided a method of driving a plasma display panel in accordance with pixel data based on a video signal, in which the plasma display panel is constructed in such a manner that a first substrate and a second substrate are arranged so as to face each other through a discharge space in which a discharge gas has been sealed, a discharge cell is formed in each of cross portions of a plurality of row electrode pairs formed on the first substrate and a plurality of column electrodes formed on the second substrate, and the panel has a phosphor layer containing a phosphor material formed on a surface of each of the discharge cells which are in contact with the discharge space and the driving method comprises: executing an addressing step and a sustaining step in each of a plurality of subfields every unit display period in the video signal and executing a resetting step of applying a reset pulse to each of first row electrodes of the row electrode pairs in at least one of the subfields prior to the addressing step; in the resetting step in a first one of the unit display periods, setting a peak electric potential of the reset pulse which is applied to one of the first row electrodes to a predetermined first peak electric potential and setting a peak electric potential which is applied to the other of the first row electrodes to a second peak electric potential lower than the first peak electric potential; and in the resetting step in a second unit display period subsequent to the first unit display period, setting the peak electric potential which is applied to each of the one and the other of the first row electrodes to the second peak electric potential.

According to the second aspect of the invention, there is provided a method of driving a plasma display panel in accordance with pixel data based on a video signal, in which the plasma display panel is constructed in such a manner that a first substrate and a second substrate are arranged so as to face each other through a discharge space in which a discharge gas has been sealed, a discharge cell is formed in each of cross portions of a plurality of row electrode pairs formed on the first substrate and a plurality of column electrodes formed on the second substrate, and the panel has a phosphor layer containing a phosphor material formed on a surface of each of the discharge cells which are in contact with the discharge space and the driving method comprises: executing an addressing step and a sustaining step in each of a plurality of subfields every unit display period in the video signal and executing a resetting step of applying a reset pulse to each of first row electrodes of the row electrode pairs in at least one of the subfields prior to the addressing step; and in the resetting step in a first one of the unit display periods, causing a reset discharge in the discharge cells by applying a first reset pulse having a predetermined peak electric potential to one of the first row electrodes and not causing the reset discharge in the discharge cell which faces the other of the first row electrodes.

According to the third aspect of the invention, there is provided a method of driving a plasma display panel in accordance with pixel data based on a video signal, in which the plasma display panel is constructed in such a manner that a first substrate and a second substrate are arranged so as to face each other through a discharge space in which a discharge gas has been sealed, a discharge cell is formed in each of cross portions of a plurality of row electrode pairs formed on the first substrate and a plurality of column electrodes formed on the second substrate, and the panel has a phosphor layer containing a phosphor material formed on a surface of each of the discharge cells which are in contact with the discharge space and the driving method comprises: executing an addressing step and a sustaining step in each of a plurality of subfields every unit display period in the video signal and executing a resetting step of applying a reset pulse having a predetermined first peak electric potential or applying a predetermined second peak electric potential lower than the first peak electric potential to each of first row electrodes of the row electrode pairs in at least one of the subfields prior to the addressing step, wherein the resetting step includes changing the number of the first row electrodes which should be used as targets to which the reset pulse having the first peak electric potential is applied and changing the number of the first row electrodes which should be used as targets to which the second peak electric potential is applied in one unit display period or a plurality of unit display periods.

According to the fourth aspect of the invention, there is provided a method of driving a plasma display panel in accordance with pixel data based on a video signal, in which the plasma display panel is constructed in such a manner that a first substrate and a second substrate are arranged so as to face each other through a discharge space in which a discharge gas has been sealed, a discharge cell is formed in each of cross portions of a plurality of row electrode pairs formed on the first substrate and a plurality of column electrodes formed on the second substrate, and the panel has a phosphor layer containing a phosphor material formed on a surface of each of the discharge cells which are in contact with the discharge space and the driving method comprises: executing an addressing step and a sustaining step in each of a plurality of subfields every unit display period in the video signal and executing a resetting step of applying a reset pulse to each of first row electrodes of the row electrode pairs in at least one of the subfields prior to the addressing step; and in the resetting step, applying a first reset pulse to one of the first row electrodes and applying a second reset pulse whose peak electric potential is smaller than that of the first reset pulse to the other of the first row electrodes, wherein the first reset pulse has a voltage value which is equal to or larger than a discharge start voltage value of the discharge cell and the second reset pulse has a voltage value smaller than the discharge start voltage value.

In the resetting step in the first unit display period, the first reset pulse having the predetermined peak electric potential is applied to one of the first row electrodes of row electrode pairs formed in the PDP and the second reset pulse having the peak electric potential smaller than that of the first reset pulse is applied to the other of the first row electrodes. In the resetting step in the second unit display period subsequent to the first unit display period, the second reset pulse is applied to each of the one and the other of the first row electrodes.

According to the above driving, while assuring the priming particles of about the number which can certainly cause the address discharge, the number of discharge cells in which the reset discharge should be caused is reduced and a dark contrast can be improved.

BRIEF DESCRIPTION OF THE DRAWINGS

FIG. 6 is a diagram showing a light-emitting pattern at each gradation;

DETAILED DESCRIPTION OF THE INVENTION

Figure 1:
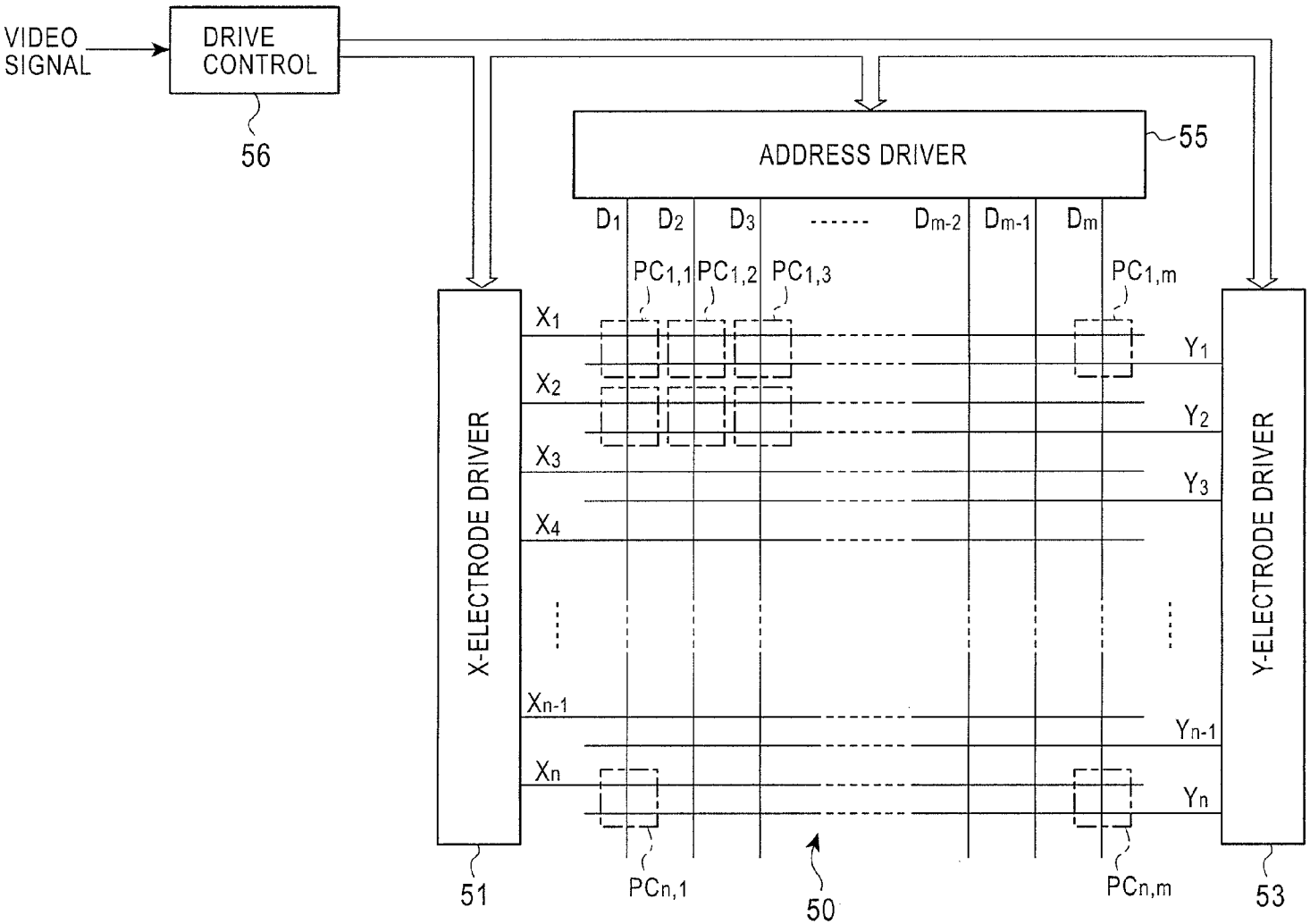
FIG. 1 is a diagram showing a schematic construction of a plasma display apparatus according to the invention.

FIG. 1 is a diagram showing a schematic construction of a plasma display apparatus for driving a plasma display panel by a driving method according to the invention.

As shown in FIG. 1, the plasma display apparatus is constructed by a PDP 50 as a plasma display panel, an X-electrode driver 51, a Y-electrode driver 53, an address driver 55, and a drive control circuit 56.

Column electrodes $D_1$ to $D_m$ arranged so as to extend in the longitudinal direction (vertical direction) of a 2-dimensional display screen and row electrodes $X_1$ to $X_n$ and row electrodes $Y_1$ to $Y_n$ arranged so as to extend in the lateral direction (horizontal direction) are formed on the PDP 50, respectively. In this instance, row electrode pairs ($Y_1$, $X_1$), ($Y_2$, $X_2$), ($Y_3$, $X_3$), . . . , and ($Y_n$, $X_n$) in each of which is constructed by the adjacent row electrodes function as first to nth display lines in the PDP 50. Every three adjacent column electrodes D among the column electrodes $D_1$ to $D_m$ form one "column" on the display screen. The three column electrodes D included in each "column" are constructed by a column electrode D for performing a red light emission, a column electrode D for performing a green light emission, and a column electrode D for performing a blue light emission. For example, a column electrode $D_1$ performs the red light emission, a column electrode $D_2$ performs the green light emission, and a column electrode $D_3$ performs the blue light emission, respectively. A discharge cell PC is formed in each cross portion (region surrounded by an alternate long and short dash line in FIG. 1) of each display line and each of the column electrodes $D_1$ to $D_m$. In this instance, one pixel is formed by the three column electrodes D (the column electrode D for performing the red light emission, the column electrode D for performing the green light emission, and the column electrode D for performing the blue light emission) which are neighboring on each display line.

Figure 2:
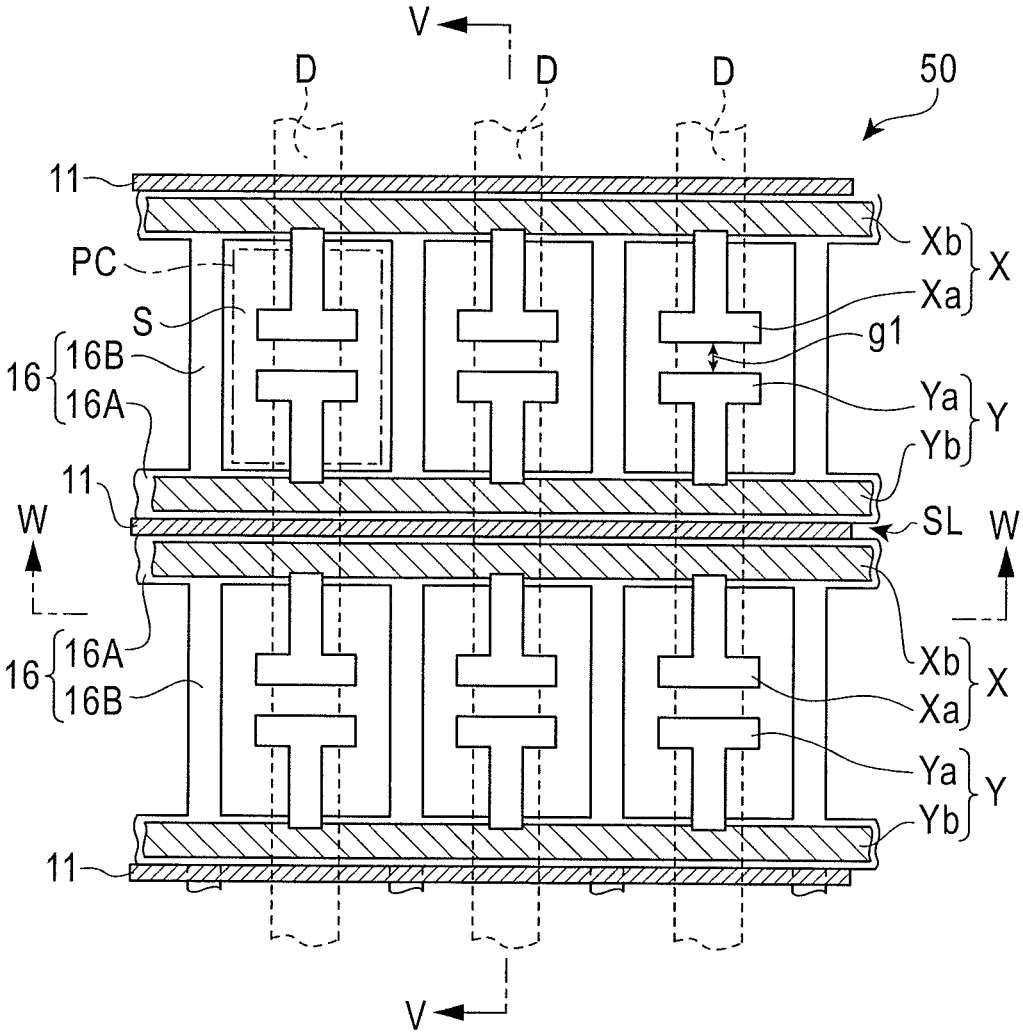
FIG. 2 is a front view schematically showing an internal structure of a PDP 50 when seen from a display plane side.
Figure 3:
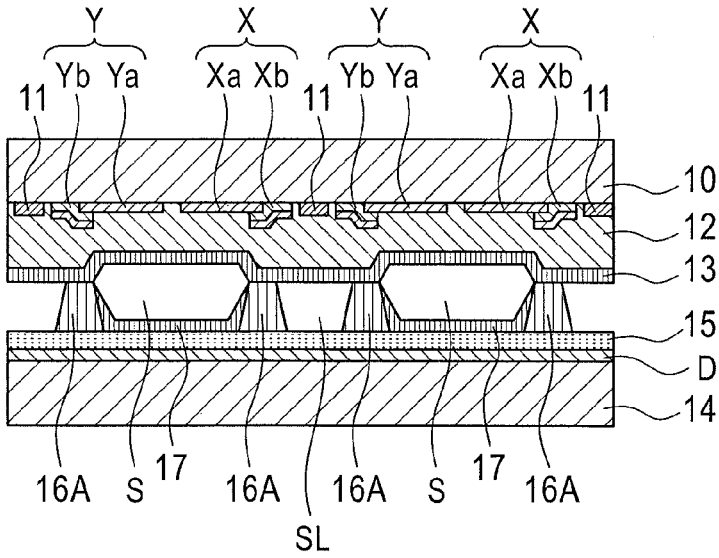
FIG. 3 is a cross sectional view taken along the line V-V in FIG. 2.
Figure 4:
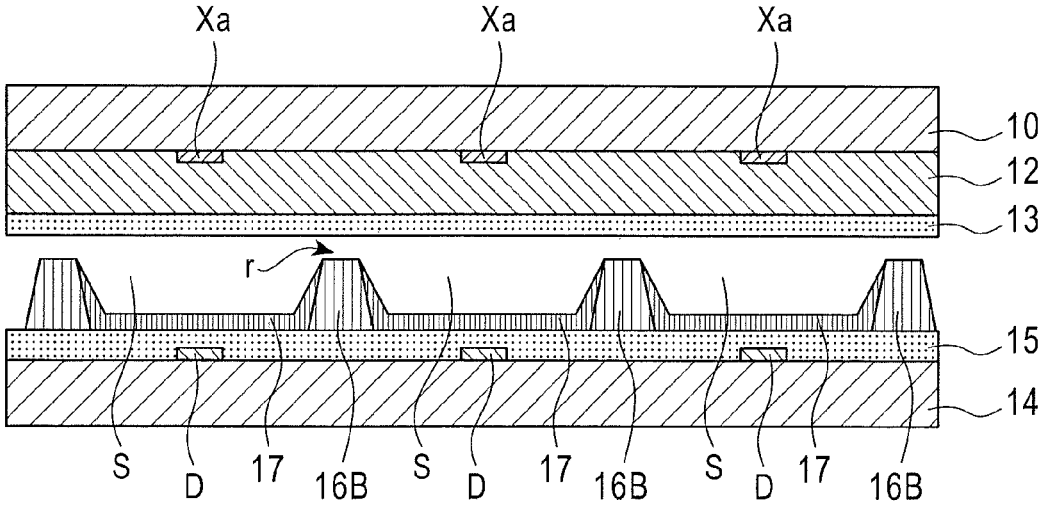
FIG. 4 is a cross sectional view taken along the line W-W in FIG. 2.

FIG. 2 is a front view schematically showing an internal structure of the PDP 50 when seen from the display plane side. In FIG. 2, the cross portions of the three adjacent column electrodes D and the two adjacent display lines are extracted and shown. FIG. 3 is a cross sectional view of the PDP 50 taken along the line V-V in FIG. 2. FIG. 4 is a cross sectional view of the PDP 50 taken along the line W-W in FIG. 2.

As shown in FIG. 2, each row electrode X is constructed by: a bus electrode Xb extending in the horizontal direction of the 2-dimensional display screen; and a T-shaped transparent electrode Xa provided in contact with a position corresponding to each discharge cell PC on the bus electrode Xb. Each row electrode Y is constructed by: a bus electrode Yb extending in the horizontal direction of the 2-dimensional display screen; and a T-shaped transparent electrode Ya provided in contact with a position corresponding to each discharge cell PC on the bus electrode Yb. Each of the transparent electrodes Xa and Ya is made of a transparent conductive film such as ITO. Each of the bus electrodes Xb and Yb is made of, for example, a metal film. As shown in FIG. 3, the row electrode X constructed by the transparent electrode Xa and the bus electrode Xb and the row electrode Y constructed by the transparent electrode Ya and the bus electrode Yb are formed on the rear surface side of a front transparent substrate 10 whose front surface side functions as a display plane of the PDP 50. In this instance, the transparent electrodes Xa and Ya in each row electrode pair (X, Y) extend toward the partner's row electrode side which mutually forms a pair and apex sides of their wide portions face each other through a discharge gap g1 of a predetermined width. On the rear surface side of the front transparent substrate 10, a light absorbing layer (light shielding layer) 11 of black or a dark color extending in the horizontal direction of the 2-dimensional display screen is formed between the row electrode pair (X, Y) and another row electrode pair (X, Y) adjacent to the row electrode pair (X, Y). Further, a dielectric layer 12 is formed on the rear surface side of the front transparent substrate 10 so that the row electrode pair (X, Y) is covered with it. On the rear surface side (surface opposite to the surface with which the row electrode pair is come into contact) of the dielectric layer 12, as shown in FIG. 3, a raising dielectric layer 12A is formed in a portion corresponding to an area where the light absorbing layer 11 and the bus electrodes Xb and Yb adjacent to the light absorbing layer 11 have been formed.

A magnesium oxide layer 13 is formed on the surfaces of the dielectric layer 12 and the raising dielectric layer 12A. The magnesium oxide layer 13 contains a magnesium oxide crystal (hereinbelow, referred to as a CL light-emission MgO crystal) serving as a secondary electron emitting material which is excited by irradiation of an electron beam and performs a CL (cathode luminescence) light emission having a peak within a range of wavelengths 200 to 300 nm, particularly, 230 to 250 nm. The CL light-emission MgO crystal is obtained by vapor-phase oxidizing a magnesium steam which is generated by heating magnesium. For example, the CL light-emission MgO crystal has a polycrystalline structure in which cubic crystals are mutually fitted or a cubic single crystal structure. A mean diameter of the CL light-emission MgO crystal is equal to or larger than 2000 Å (angstroms) (measurement result according to a BET method). In the case of forming a vapor phase method magnesium oxide single crystal having a large mean diameter of 2000 Å or more, it is necessary to raise a heating temperature at the time of generating the magnesium steam. A length of flame in which magnesium and oxygen react, therefore, becomes long. Since a temperature difference between the flame and the ambient increases, the larger the mean diameter of the vapor phase method magnesium oxide single crystal is, the larger number of vapor phase magnesium oxide single crystals having an energy level corresponding to a peak wavelength (for example, near 235 nm; within 230 to 250 nm) of the CL light emission as mentioned above are formed. The vapor phase magnesium oxide single crystal formed by increasing an amount of magnesium which is evaporated per unit time and further increasing the reaction area of magnesium and oxygen so that magnesium can react a larger quantity of oxygen as compared with those of a general vapor phase oxidizing method has the energy level corresponding to the peak wavelength of the CL light emission as mentioned above. By depositing the CL light-emission MgO crystal onto the surface of the dielectric layer 12 by a spraying method, an electrostatic coating method, or the like, the magnesium oxide layer 13 is formed. The magnesium oxide layer 13 can be also formed by forming a thin film magnesium oxide layer onto the surface of the dielectric layer 12 by evaporation deposition or a sputtering method and depositing the CL light-emission MgO crystal onto the magnesium oxide layer.

On a rear substrate 14 arranged in parallel with the front transparent substrate 10, each of the column electrodes D is formed so as to extend in the direction which perpendicularly crosses the row electrode pair (X, Y) at a position where each column electrode D faces the transparent electrodes Xa and Ya in each row electrode pair (X, Y). A white column electrode protecting layer 15 with which the column electrodes D are covered is further formed on the rear substrate 14. Partition walls 16 are formed on the column electrode protecting layer 15. The partition walls 16 are formed in a ladder shape by: lateral walls 16A extending in the lateral direction corresponding to the 2-dimensional display screen at the positions corresponding to the bus electrodes Xb and Yb of each row electrode pair (X, Y); and vertical walls 16B extending in the vertical direction of the 2-dimensional display screen at the intermediate positions between the respective adjacent column electrodes D. The partition walls 16 in the ladder shape as shown in FIG. 2 are further formed every display line of the PDP 50. A gap SL as shown in FIG. 2 exists between the adjacent partition walls 16. The discharge cells PC including independent discharge spaces S and transparent electrodes Xa and Ya are segmented by the ladder-shaped partition walls 16. A discharge gas containing a xenon gas is sealed in the discharge space S. Phosphor layers 17 are formed on side walls of the lateral walls 16A, side walls of the vertical walls 16B, and a surface of the column electrode protecting layer 15 in each discharge cell PC so that all of those surfaces are covered with the phosphor layers 17. The phosphor layer 17 is actually made of three kinds of phosphor for performing the red light emission, phosphor for performing the green light emission, and phosphor for performing the blue light emission.

Figure 5:
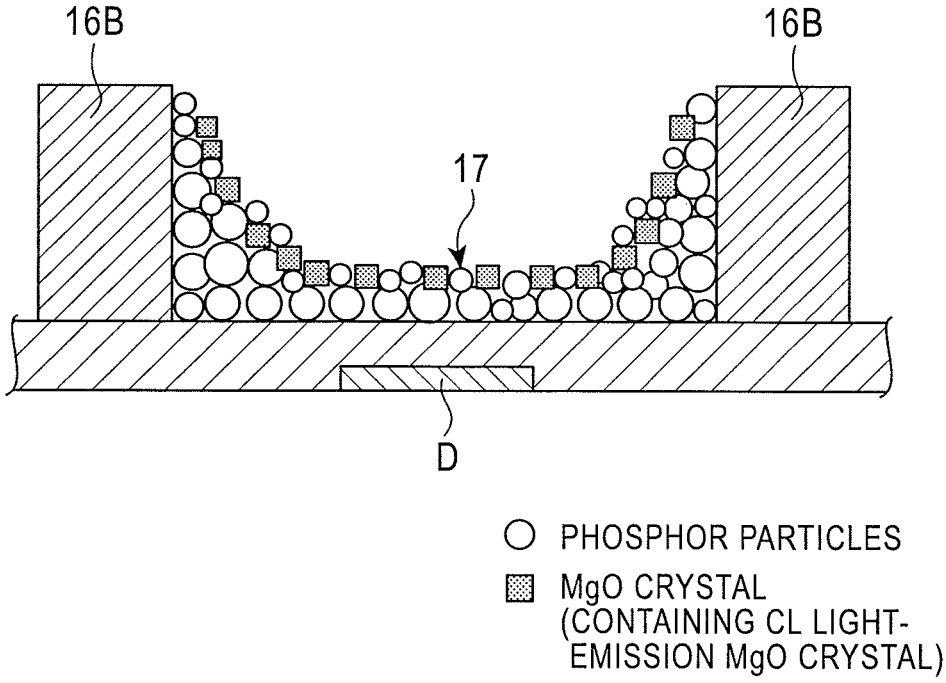
FIG. 5 is a diagram schematically showing an MgO crystal contained in a phosphor layer 17.

The MgO crystal (including the CL light-emission MgO crystal) serving as a secondary electron emitting material is contained in the phosphor layer 17, for example, in a form as shown in FIG. 5. In this instance, the MgO crystal is exposed onto at least the surface of the phosphor layer 17, that is, onto the surface which is come into contact with the discharge space S from the phosphor layer 17 so as to be come into contact with the discharge gas.

Since the magnesium oxide layer 13 is come into contact with the lateral wall 16A as shown in FIG. 3, they are mutually closed between the discharge space S of each discharge cell PC and the gap SL. Since the vertical wall 16B is not in contact with the magnesium oxide layer 13 as shown in FIG. 4, a gap r exists between them. That is, the discharge spaces S of the discharge cells PC which are neighboring in the lateral direction of the 2-dimensional display screen are communicated through the gap r.

First, the drive control circuit 56 converts the input video signal every pixel into 8-bit pixel data in which all luminance levels are expressed by 256 gradations, and executes a multi-gradation forming process constructed by an error diffusing process and a dither process to the pixel data. That is, first, in the error diffusing process, the data of upper 6 bits of the pixel data is set to display data, the data of remaining lower 2 bits is set to error data, and the data obtained by weight-adding the error data in the pixel data corresponding to respective peripheral pixels is reflected to the display data, thereby obtaining error diffusing process pixel data of 6 bits. According to the error diffusing process, since the luminance of the lower 2 bits in the original pixel is falsely expressed by the peripheral pixels, a luminance gradation expression that is equivalent to the pixel data of 8 bits mentioned above can be performed by the display data of 6 bits less than 8 bits. The drive control circuit 56 subsequently executes the dither process to the error diffusing process pixel data of 6 bits obtained by the error diffusing process. In the dither process, a plurality of adjacent pixels are set to one pixel unit, dither coefficients formed by different coefficient values are allocated to the error diffusing process pixel data corresponding to the respective pixels in one pixel unit, and the obtained pixel data is added, thereby obtaining dither addition pixel data. According to the addition of the dither coefficients, when seen by the pixel unit as mentioned above, the luminance corresponding to 8 bits can be expressed even by the upper 4 bits of the dither addition pixel data. The drive control circuit 56, therefore, sets the data of upper 4 bits of the dither addition pixel data into 4-bit multi-gradation pixel data PDs in which all luminance level ranges are expressed by 16 gradations. The drive control circuit 56 converts the multi-gradation pixel data PDs into 14-bit pixel drive data GD in accordance with a data conversion table as shown in FIG. 6. The drive control circuit 56 makes the first to fourteenth bits in the pixel drive data GD correspond to subfields SF1 to SF14 (which will be described hereinafter) and supplies bit digits corresponding to the subfields SF as pixel drive data bits to the address driver 55 every data of one display line (m bits).

Figure 7:
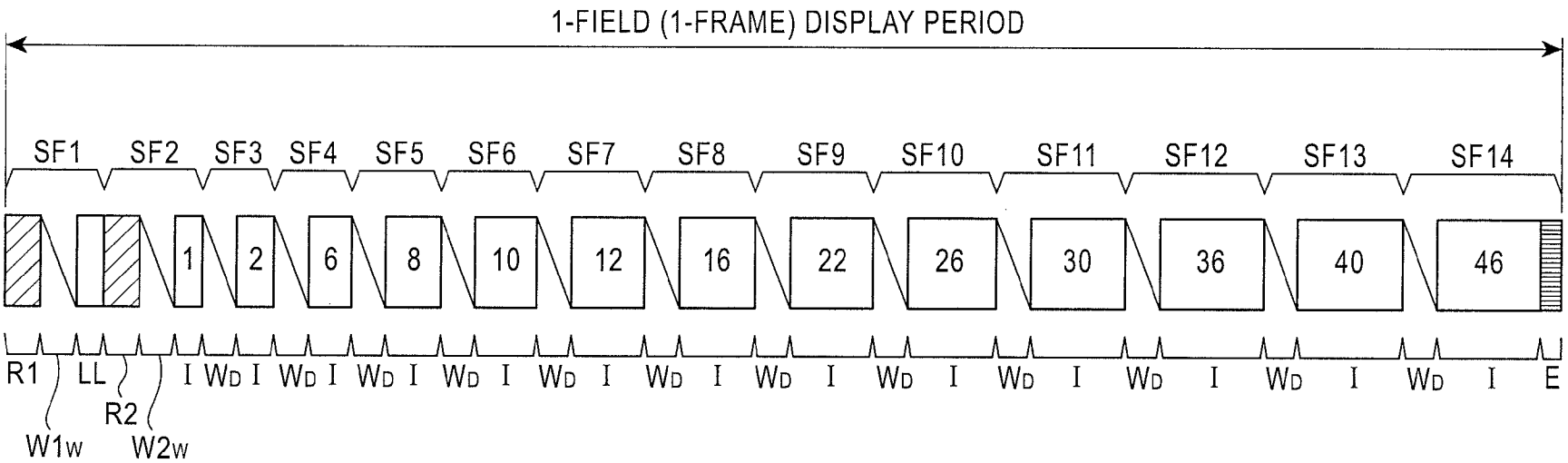
FIG. 7 is a diagram showing an example of a light-omission driving sequence which is used in the plasma display apparatus shown in FIG. 1.

The drive control circuit 56 further supplies various kinds of control signals adapted to drive the PDP 50 having the foregoing structure to a panel driver constructed by the X-electrode driver 51, Y-electrode driver 53, and address driver 55 in accordance with a light-emission driving sequence as shown in FIG. 7. That is, in the head subfield SF1 in a 1-field or 1-frame display period (hereinbelow, referred to as a unit display period) as shown in FIG. 7, the drive control circuit 56 supplies various kinds of control signals to the panel driver in order to sequentially execute the driving according to each of a first resetting step R1, a first selective write addressing step $W1_W$, and a micro light-emitting step LL. In the subfield SF2 subsequent to the subfield SF1, the drive control circuit 56 supplies various kinds of control signals to the panel driver in order to sequentially execute the driving according to each of a second resetting step R2, a second selective write addressing step $W2_W$, and a sustaining step I. In each of the subfields SF3 to SF14, the drive control circuit 56 supplies various kinds of control signals to the panel driver in order to sequentially execute the driving according to each of a selective erase addressing step $W_D$ and the sustaining step I. Only in the last subfield SF14 in the 1-field display period, the drive control circuit 56 supplies various kinds of control signals to the panel driver in order to sequentially execute the driving according to an erasing step E after the execution of the sustaining step I.

Figure 8:
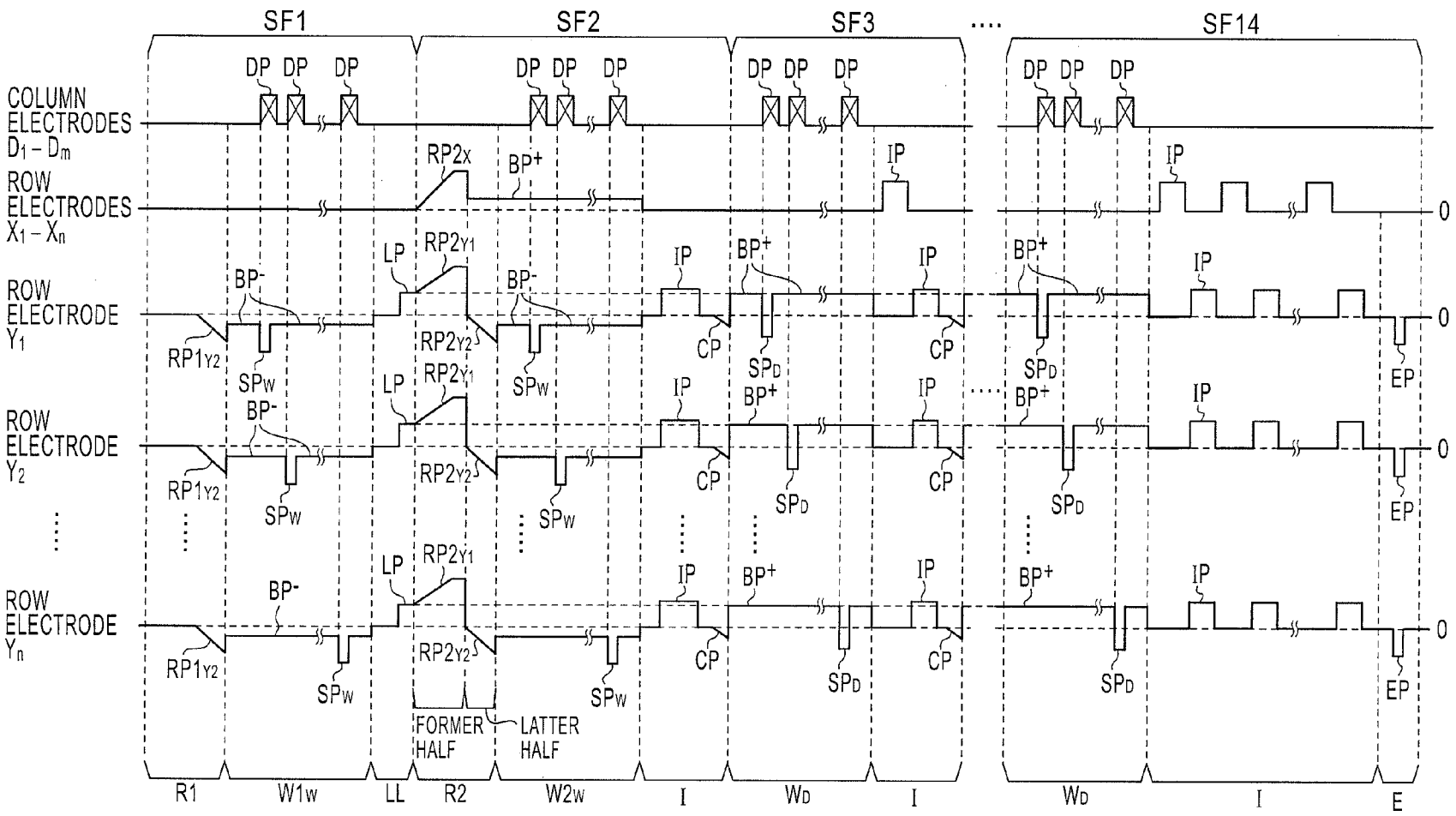
FIG. 8 is a diagram showing a first driving pulse applying sequence GTS1 at the time when it is applied to the PDP 50 in accordance with the light-emission driving sequence shown in FIG. 7.
Figure 9:
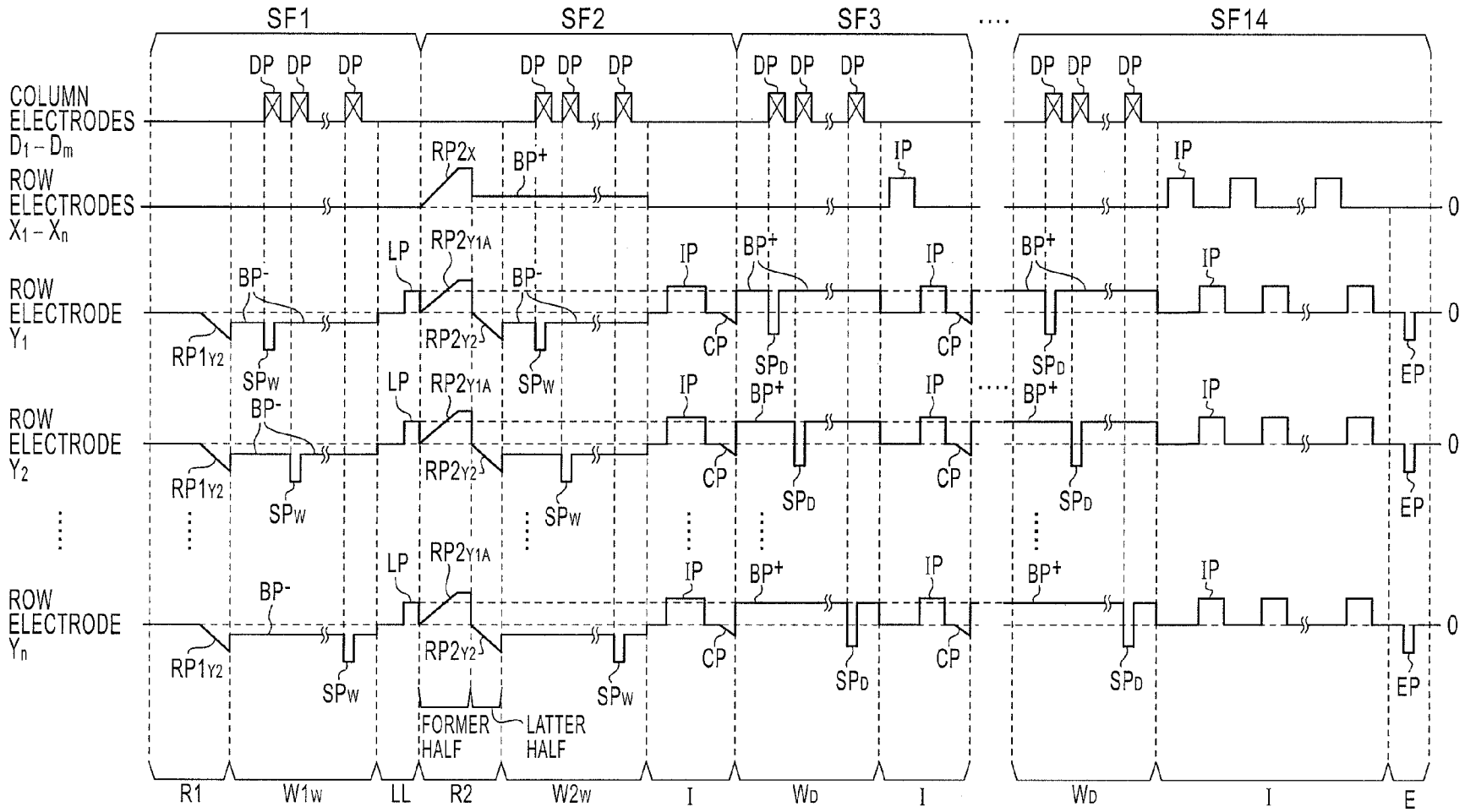
FIG. 9 is a diagram showing a second driving pulse applying sequence GTS2 at the time when it is applied to the PDP 50 in accordance with the light-emission driving sequence shown in FIG. 7.
Figure 10:
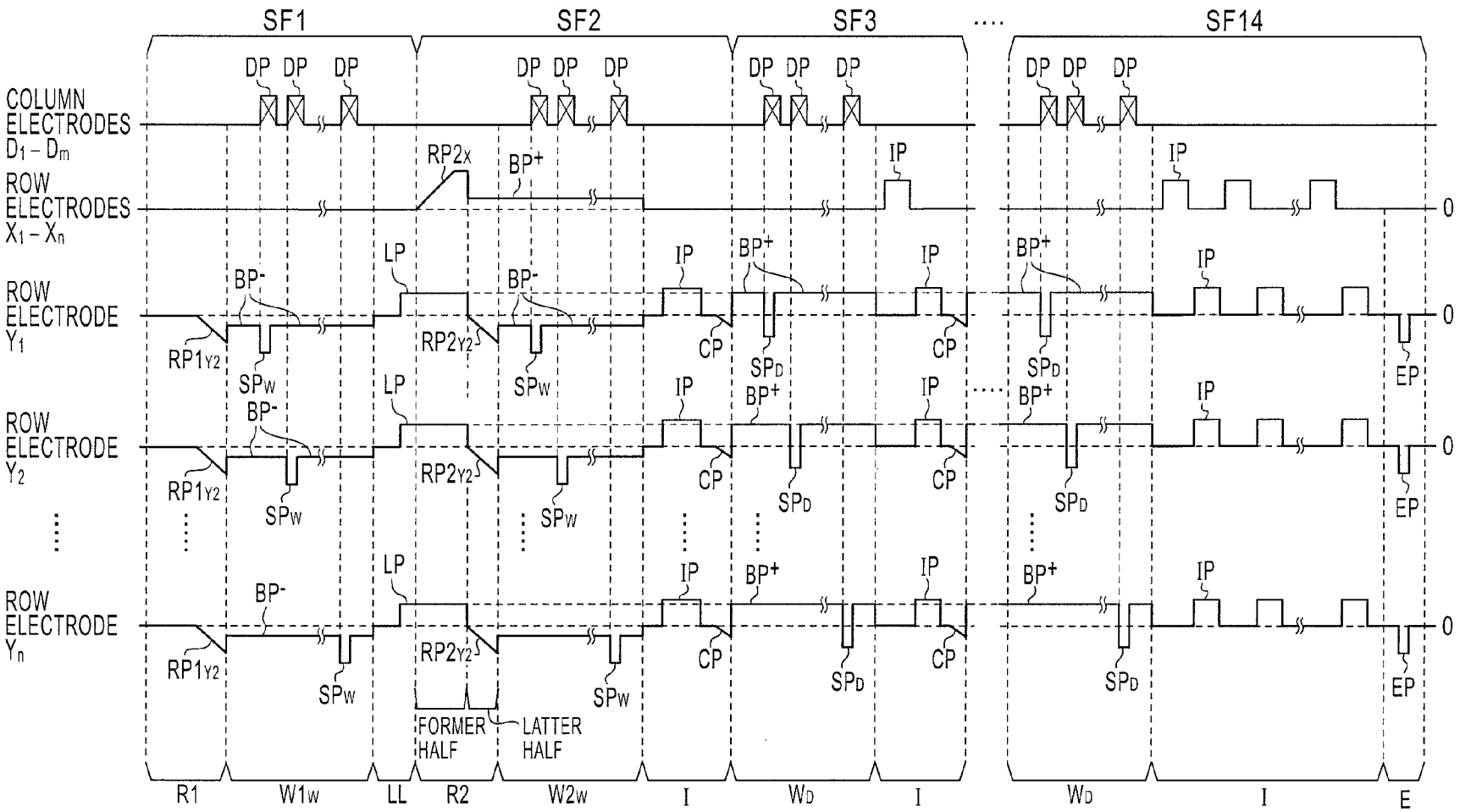
FIG. 10 is a diagram showing a third driving pulse applying sequence GTS3 at the time when it is applied to the PDP 50 in accordance with the light-emission driving sequence shown in FIG. 7.

In response to the various control signals supplied from the drive control circuit 56, the panel driver uses one of first to third driving pulse applying sequences GTS1 to GTS3 as shown in FIGS. 8 to 10 every display line and every unit display period and applies various kinds of driving pulses to the column electrodes D and the row electrodes X and Y of the PDP 50.

Figure 11:
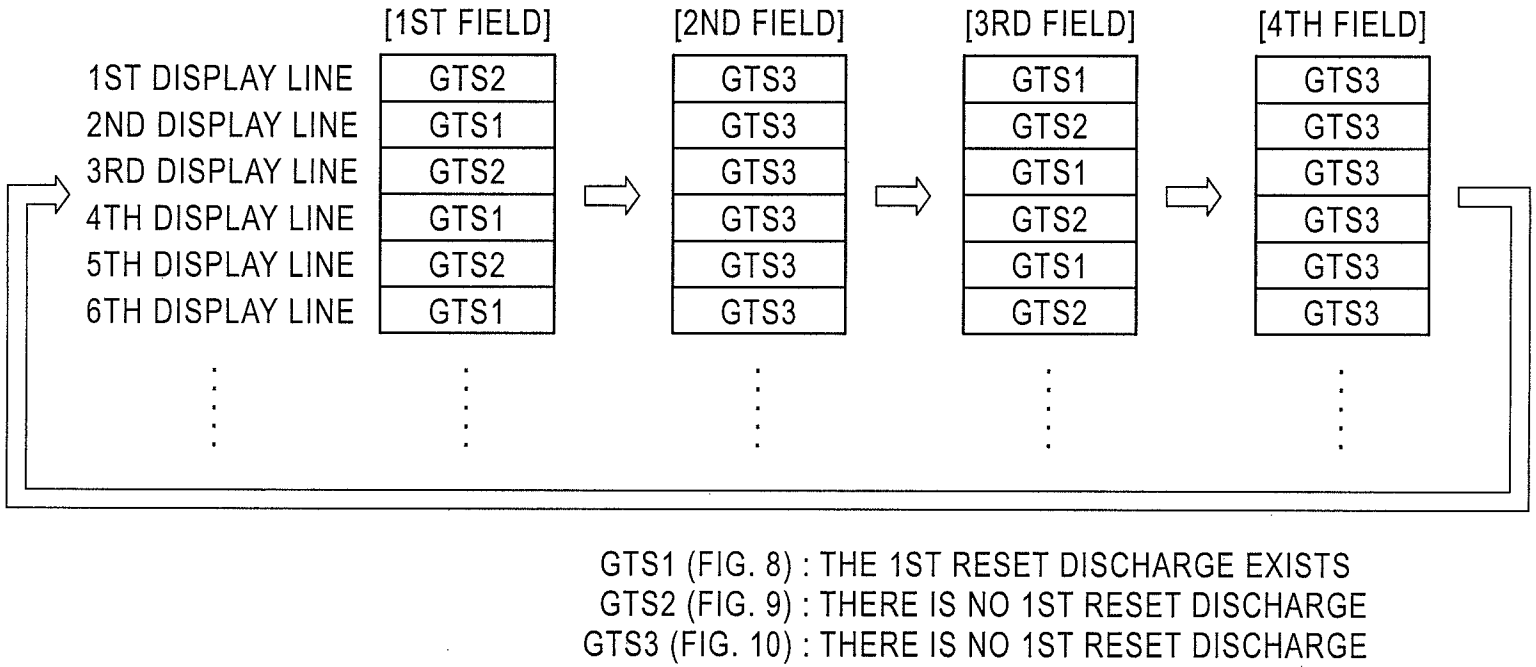
FIG. 11 is a diagram showing an example of a driving form of each display line according to a 4-field period.

For example, as shown in FIG. 11, the panel driver applies the various driving pulses to the PDP 50 every four continuous fields or frames in the input video signal in the first field in such a manner that those pulses are supplied to the odd-number designated display lines in accordance with the second driving pulse applying sequence GTS2 (FIG. 9) and are supplied to the even-number designated display lines in accordance with the first driving pulse applying sequence GTS1 (FIG. 8). In the next second field, as shown in FIG. 11, the panel driver applies the various driving pulses to the PDP 50 in such a manner that those pulses are supplied to all of the display lines in accordance with the third driving pulse applying sequence GTS3 (FIG. 10). In the next third field, the panel driver applies the various driving pulses to the PDP 50 in such a manner that those pulses are supplied to the odd-number designated display lines in accordance with the first driving pulse applying sequence GTS1 (FIG. 8) and are supplied to the even-number designated display lines in accordance with the second driving pulse applying sequence GTS2 (FIG. 9). In the fourth field, the panel driver applies the various driving pulses to the PDP 50 in such a manner that those pulses are supplied to all of the display lines in accordance with the third driving pulse applying sequence GTS3 (FIG. 10). The panel driver periodically and repetitively executes the operations in the first to fourth fields as shown in FIG. 11.

The applying operation of the driving pulses which is executed by the panel driver (the X-electrode driver 51, the Y-electrode driver 53, and the address driver 55) in accordance with the first to third driving pulse applying sequences GTS1 to GTS3 as shown in FIGS. 8 to 10 will be described hereinbelow. In FIGS. 8 to 10, only the operations in the subfields SF1 to SF3 among the subfields SF1 to SF14 shown in FIG. 7 and the last subfield SF14 are extracted and shown.

[First Driving Pulse Applying Sequence GTS1]

As shown in FIG. 8, first, in the first resetting step R1 of the head subfield SF1, the address driver 55 sets the column electrodes $D_1$ to $D_m$ into a state of a grounding potential (0 volt). The Y-electrode driver 53 generates a reset pulse $RP1_{Y2}$ of a negative polarity whose potential shift in a leading edge portion with the elapse of time is gentle and applies it to all of the row electrodes $Y_1$ to $Y_n$. A negative peak electric potential in the reset pulse $RP1_{Y2}$ has been set to an electric potential higher than a peak electric potential of a write scanning pulse $SP_W$ of a negative polarity, which will be described hereinafter, that is, it has been set to an electric potential near 0 volt. That is, this is because if the peak electric potential of the reset pulse $RP1_{Y2}$ is set to be lower than the peak electric potential of the write scanning pulse $SP_W$, a strong discharge is caused between the row electrode Y and the column electrode D, wall charges formed near the column electrode D are largely erased, and an address discharge in the next first selective write addressing step $W1_W$ becomes unstable. During the period of time, the X-electrode driver 51 sets all of the row electrodes $X_1$ to $X_n$ into the grounding potential (0 volt). A weak reset discharge is caused between the row electrodes X and Y in all of the discharge cells PC in accordance with the applying of the reset pulse $RP1_{Y2}$ as mentioned above. By the reset discharge, the wall charges formed near each of the row electrodes X and Y in each discharge cell PC are erased. All of the discharge cells PC are initialized to a state where a sustain discharge is not caused in the sustaining step I, which will be described hereinafter, (hereinbelow, referred to as a turn-off mode state). A state where the sustain discharge is caused in the sustaining step I is referred to as a turn-on mode state hereinbelow.

Further, a weak discharge is also caused between the row electrode Y and the column electrode D in all of the discharge cells PC in accordance with the applying of the reset pulse $RP1_{Y2}$. By the weak discharge, a part of wall charges of a positive polarity formed near the column electrode D is erased and an amount of wall charges is adjusted to such an amount that the selective write address discharge can be correctly caused in the next first selective write addressing step $W1_W$.

Subsequently, in the first selective write addressing step $W1_W$ of the subfield SF1, while simultaneously applying a base pulse $BP^-$ having a peak electric potential of the negative polarity as shown in FIG. 8 to the row electrodes $Y_1$ to $Y_n$, the Y-electrode driver 53 sequentially and selectively applies the write scanning pulse $SP_W$ having the peak electric potential of the negative polarity lower than the peak electric potential of the base pulse $BP^-$ to each of the row electrodes $Y_1$ to $Y_n$. For the period of time, the X-electrode driver 51 applies the voltage of 0 volt to each of the row electrodes $X_1$ to $X_n$. Further, in the first selective write addressing step $W1_W$, the address driver 55 forms a pixel data pulse DP having a pulse voltage according to a logic level of a pixel drive data bit DB corresponding to the subfield SF1. For example, the address driver 55 forms the pixel data pulse DP having the peak electric potential of the positive polarity in the case where the pixel drive data bit DB of a logic level "1" is supplied in order to set the discharge cell PC into the turn-on mode. The address driver 55 forms the pixel data pulse DP of a low voltage (0 volt) in accordance with the pixel drive data bit DB of a logic level "0" in order to set the discharge cell PC into the turn-off mode. The address driver 55 sequentially applies the pixel data pulses DP every display line (m pulses) to the column electrodes $D_1$ to $D_m$ synchronously with timing for applying each write scanning pulse $SP_W$. In this instance, a selective write address discharge is caused between the column electrode D and the row electrode Y in the discharge cell PC to which the pixel data pulses DP of the high voltage has been applied in order to set the discharge cell PC into the turn-on mode simultaneously with the write scanning pulse $SP_W$. By the selective write address discharge, the discharge cell PC is set into a state where the wall charges of the positive polarity have been formed near the row electrode Y and the wall charges of the negative polarity have been formed near the column electrode D, that is, into the turn-on mode. The selective write address discharge as mentioned above is not caused between the column electrode D and the row electrode Y in the discharge cell PC to which the pixel data pulses DP of the low voltage (0 volt) has been applied in order to set the discharge cell PC into the turn-off mode simultaneously with the write scanning pulse $SP_W$. The discharge cell PC, therefore, maintains the state just before it, that is, the turn-off mode state initialized in the first resetting step R1 is maintained.

Subsequently, in the micro light-emitting step LL of the subfield SF1, the Y-electrode driver 53 simultaneously applies a micro light-emitting pulse LP having a predetermined peak electric potential of the positive polarity as shown in FIG. 8 to the row electrodes $Y_1$ to $Y_n$. A discharge is caused between the column electrode D and the row electrode Y in the discharge cell PC which has been set into the turn-on mode in accordance with the applying of the micro light-emitting pulse LP (hereinbelow, this discharge is referred to as a micro light-emitting discharge). That is, in the micro light-emitting step LL, such an electric potential that although the discharge is caused between the row electrode Y and the column electrode D in the discharge cell PC, no discharge is caused between the row electrodes X and Y to is applied to the row electrode Y, thereby causing the micro light-emitting discharge only between the column electrode D and the row electrode Y in the discharge cell PC which has been set into the turn-on mode. The peak electric potential of the positive polarity of the micro light-emitting pulse LP is the same as a peak electric potential of a base pulse $BP^+$ of the positive polarity which is applied to the row electrode Y in the selective erase addressing step $W_D$ of each of the subfields SF3 to SF14, which will be described hereinafter, and is lower than a peak electric potential of a sustaining pulse IP which is applied in the sustaining step I of each of the subfields SF2 to SF14, which will be described hereinafter. In the Y-electrode driver 53, thus, a power source to generate the positive polarity peak electric potential in the micro light-emitting pulse LP and a power source to generate the positive polarity peak electric potential in the base pulse $BP^+$ can be shared.

In the micro light-emitting step LL, the micro light-emitting discharge which is caused in the discharge cell PC in accordance with the applying of the micro light-emitting pulse LP is a discharge which is caused between both of the row electrode Y and the column electrode D while setting the row electrode Y side to an anode and setting the column electrode D side to a cathode (hereinbelow, this discharge is referred to as a column-side cathode discharge). Further, since the micro light-emitting discharge is a discharge caused by the micro light-emitting pulse LP whose peak electric potential is lower than that of the sustaining pulse IP, the light emission luminance accompanied by the discharge is lower than that by the sustain discharge which is caused between the row electrodes X and Y in the sustaining step I, which will be described hereinafter. That is, the discharge accompanied with a micro light emission of such a level that can be used for display is caused as a micro light-emitting discharge. In this instance, in the first selective write addressing step $W1_W$ which is executed just before the micro light-emitting step LL, the selective write address discharge is caused between the column electrode D and the row electrode Y in the discharge cell PC. In the subfield SF1, therefore, the luminance corresponding to the gradation whose luminance is higher than the luminance level 0 by one level is expressed by the light emission accompanied by the selective write address discharge and the light emission accompanied by the micro light-emitting discharge. After completion of the micro light-emitting discharge, the wall charges of the negative polarity are formed near the row electrode Y and the wall charges of the positive polarity are formed near the column electrode D, respectively.

Subsequently, in the former half portion of the second resetting step R2 of the subfield SF2, the Y-electrode driver 53 applies a reset pulse $RP2_{Y1}$ having such a waveform that its electric potential rises slowly from a state of the positive polarity peak electric potential in the micro light-emitting pulse LP and reaches a predetermined positive polarity peak electric potential to all of the row electrodes $Y_1$ to $Y_n$. In this instance, the Y-electrode driver 53 forms a leading waveform of the reset pulse $RP2_{Y1}$ by adding the predetermined positive polarity electric potential to the positive polarity peak electric potential in the micro light-emitting pulse LP. In the leading waveform of the reset pulse $RP2_{Y1}$, a potential shift in the leading edge portion with the elapse of time is gentler than that of the sustaining pulse IP, which will be described hereinafter. For this period of time, the address driver 55 sets the column electrodes $D_1$ to $D_m$ into the state of the grounding potential (0 volt). The X-electrode driver 51 applies a reset pulse $RP2_X$ having the positive polarity peak electric potential which can prevent a face discharge between the row electrodes X and Y that is caused by applying the reset pulse $RP2_{Y1}$ to each of all of the row electrodes $X_1$ to $X_n$. If no face discharge is caused between the row electrodes X and Y here, the X-electrode driver 51 may set all of the row electrodes $X_1$ to $X_n$ to the grounding potential (0 volt) in place of applying the reset pulse $RP2_X$. A relatively strong first reset discharge is caused between the row electrode Y and the column electrode D in the discharge cells PC in which the column-side cathode discharge is not caused in the micro light-emitting step LL in each of the discharge cells PC in accordance with the applying of the reset pulse $RP2_{Y1}$. That is, in the former half portion of the second resetting step R2, by applying the voltage between both of the row electrode Y and the column electrode D while setting the row electrode Y to the anode side and setting the column electrode D to the cathode side, the column-side cathode discharge in which a current flows from the row electrode Y toward the column electrode D is caused as a first reset discharge. In association with the first reset discharge, charged particles of such an amount that the selective write address discharge can be certainly caused in the next second selective write addressing step $W2_W$ are formed in the discharge cell PC. In the discharge cell PC in which the micro light emission discharge has already been caused in the micro light-emitting step LL, even if the reset pulse $RP2_{Y1}$ is applied, no discharge is caused. Just after completion of the former half portion of the second resetting step R2, therefore, a state where the wall charges of the negative polarity are formed near the row electrode Y and the wall charges of the positive polarity are formed near the column electrode D in all of the discharge cells PC is obtained.

In the latter half portion of the second resetting step R2 of the subfield SF2, the Y-electrode driver 53 applies a reset pulse $RP2_{Y2}$ having such a pulse waveform that its electric potential decreases slowly with the elapse of time and reaches the peak electric potential of the negative polarity as shown in FIG. 8 to the row electrodes $Y_1$ to $Y_n$. Further, in the latter half portion of the second resetting step R2, the X-electrode driver 51 applies the base pulse $BP^+$ having the positive polarity peak electric potential to each of the row electrodes $X_1$ to $X_n$. A second reset discharge is caused between the row electrodes X and Y in all of the discharge cells PC in accordance with the applying of the reset pulse $RP2_{Y2}$ of the negative polarity and the base pulse $BP^+$ of the positive polarity as mentioned above. In accordance with the second reset discharge, the wall charges formed near each of the row electrodes X and Y in each discharge cell PC are erased and all of the discharge cells PC are initialized to the turn-off mode. Further, the weak discharge is also caused between the row electrode Y and the column electrode D in all of the discharge cells PC in accordance with the applying of the reset pulse $RP2_{Y2}$. A part of the wall charges of the positive polarity formed near the column electrode D is erased by the discharge and an amount of wall charges is adjusted to such an amount that the selective write address discharge can be correctly caused in the next second selective write addressing step $W2_W$. The negative polarity peak electric potential of the reset pulse $RP2_{Y2}$ and the positive polarity peak electric potential of the base pulse $BP^+$ are equal to the minimum electric potential at which the second reset discharge can be certainly caused between the row electrodes X and Y in accordance with the first reset discharge in consideration of the wall charges formed near each of the row electrodes X and Y. The negative polarity peak electric potential in the reset pulse $RP2_{Y2}$ is set to an electric potential higher than the negative polarity peak electric potential of the write scanning pulse $SP_W$, that is, to an electric potential near 0 volt. In other words, this is because if the peak electric potential of the reset pulse $RP2_{Y2}$ is set to be lower than the negative polarity peak electric potential of the write scanning pulse $SP_W$, a strong discharge is caused between the row electrode Y and the column electrode D, the wall charges formed near the column electrode D are largely erased, and an address discharge in the following second selective write addressing step $W2_W$ becomes unstable.

In the second selective write addressing step $W2_W$, while simultaneously applying the base pulse $BP^-$ having the negative polarity peak electric potential as shown in FIG. 8 to the row electrodes $Y_1$ to $Y_n$, the Y-electrode driver 53 sequentially and selectively applies the write scanning pulse $SP_W$ having the peak electric potential of the negative polarity lower than that of the base pulse $BP^-$ to each of the row electrodes $Y_1$ to $Y_n$. For the period of time, the X-electrode driver 51 applies the base pulse $BP^+$ having the positive polarity peak electric potential to each of the row electrodes $X_1$ to $X_n$. Further, in the second selective write addressing step $W2_W$, first, the address driver 55 forms the pixel data pulse DP having the peak electric potential according to the logic level of the pixel drive data bit DB corresponding to the subfield SF2. For example, the address driver 55 forms the pixel data pulse DP having the peak electric potential of the positive polarity in the case where the pixel drive data bit DB of the logic level "1" is supplied in order to set the discharge cell PC into the turn-on mode. The address driver 55 forms the pixel data pulse DP of the low voltage (0 volt) in accordance with the pixel drive data bit DB of the logic level "0" in order to set the discharge cell PC into the turn-off mode. The address driver 55 sequentially applies the pixel data pulses DP every display line (m pulses) to the column electrodes $D_1$ to $D_m$ synchronously with timing for applying each write scanning pulse $SP_W$. In this instance, a selective write address discharge is caused between the column electrode D and the row electrode Y in the discharge cell PC to which the pixel data pulses DP of the high voltage has been applied in order to set the discharge cell PC into the turn-on mode simultaneously with the write scanning pulse $SP_W$. Further, the weak discharge is also caused between the row electrodes X and Y in the discharge cell PC just after completion of the selective write address discharge. That is, although the voltages according to the base pulse $BP^-$ and the base pulse $BP^+$ are applied between the row electrodes X and Y after the write scanning pulse $SP_W$ was applied, those voltages have been set to the voltages lower than a discharge start voltage of each discharge cell PC. Even if those voltages are merely applied, therefore, no discharge is caused in the discharge cell PC. When the selective write address discharge is caused, however, the discharge is induced by the selective write address discharge and caused between the row electrodes X and Y merely by applying the voltage by the base pulse $BP^-$ and the base pulse $BP^+$. Due to the discharge and the selective write address discharge, the discharge cell PC is set into a state where the wall charges of the positive polarity are formed near the row electrode Y, the wall charges of the negative polarity are formed near the row electrode X, and the wall charges of the negative polarity are formed near the column electrode D, respectively, that is, into the turn-on mode. The selective write address discharge as mentioned above is not caused between the column electrode D and the row electrode Y in the discharge cell PC to which the pixel data pulse DP of the low voltage (0 volt) has been applied in order to set the discharge cell into the turn-off mode simultaneously with the write scanning pulse $SP_W$. The discharge cell PC, therefore, maintains the state just before it, that is, the turn-off mode state which has been initialized in the second resetting step R2.

Subsequently, in the sustaining step I of the subfield SF2, the Y-electrode driver 53 generates the sustaining pulse IP having the peak electric potential of the positive polarity by one pulse and simultaneously applies it to each of the row electrodes $Y_1$ to $Y_n$. For the period of time, the X-electrode driver 51 sets the row electrodes $X_1$ to $X_n$ into the state of the grounding potential (0 volt). The address driver 55 sets the column electrodes $D_1$ to $D_m$ into the grounding potential (0 volt). A sustain discharge is caused between the row electrodes X and Y in the discharge cell PC which has been set in the turn-on mode in accordance with the applying of the sustaining pulse IP. Light which is irradiated from the phosphor layer 17 in association with the sustain discharge is irradiated to an outside through the front transparent substrate 10, so that the display light emission of one time corresponding to the luminance weight of the subfield SF2 is performed. The discharge is also caused between the row electrode Y and the column electrode D in the discharge cell PC which has been set in the turn-on mode in accordance with the applying of the sustaining pulse IP. Due to the discharge and the sustain discharge, the wall charges of the negative polarity are formed near the row electrode Y and the wall charges of the positive polarity are formed near each of the row electrode X and the column electrode D in the discharge cell PC, respectively. After the sustaining pulse IP was applied, the Y-electrode driver 53 applies a wall charge adjusting pulse CP having a peak electric potential of the negative polarity whose potential shift in a leading edge portion with the elapse of time is gentle as shown in FIG. 8 to the row electrodes $Y_1$ to $Y_n$. In accordance with the applying of the wall charge adjusting pulse CP, a weak erasing discharge is caused in the discharge cell PC in which the sustain discharge has been caused as mentioned above. A part of the wall charges formed in the discharge cell is erased and an amount of wall charges in the discharge cell PC is adjusted to such an amount that the selective erase address discharge can be correctly caused in the next selective erase addressing step $W_D$.

Subsequently, in the selective erase addressing step $W_D$ of each of the subfields SF3 to SF14, while applying the base pulse $BP^+$ having the peak electric potential of the positive polarity to each of the row electrodes $Y_1$ to $Y_n$, the Y-electrode driver 53 sequentially and selectively applies an erase scanning pulse SP, having the peak electric potential of the negative polarity as shown in FIG. 8 to each of the row electrodes $Y_1$ to $Y_n$. As mentioned above, the positive polarity peak electric potential in the base pulse $BP^+$ has the same electric potential as the positive polarity peak electric potential of the micro light-emitting pulse LP which is applied to the row electrode Y in the micro light-emitting step LL, and is applied in order to prevent the erroneous discharge between the row electrodes X and Y for an execution period of time of the selective erase addressing step $W_D$. The X-electrode driver 51 sets each of the row electrodes $X_1$ to $X_n$ into the grounding potential (0 volt) for an execution period of time of the selective erase addressing step $W_D$. In the selective erase addressing step $W_D$, first, the address driver 55 converts the pixel drive data bit DB corresponding to the subfield SF into the pixel data pulse DP having the peak electric potential according to its logic level. For example, in the case where the pixel drive data bit DB of the logic level "1" has been supplied in order to shift the discharge cell PC from the turn-on mode to the turn-off mode, the address driver 55 converts the pixel drive data bit DB into the pixel data pulse DP having the peak electric potential of the positive polarity. In the case where the pixel drive data bit DB of the logic level "0" has been supplied in order to maintain the present state of the discharge cell PC, the address driver 55 converts it into the pixel data pulse DP of the low voltage (0 volt). The address driver 55 sequentially applies the pixel data pulses DP every display line (m pulses) to the column electrodes $D_1$ to $D_m$ synchronously with the timing for applying each erase scanning pulse $SP_D$. In this instance, a selective erase address discharge is caused between the column electrode D and the row electrode Y in the discharge cell PC to which the pixel data pulses DP of the high voltage has been applied simultaneously with the erase scanning pulse $SP_D$. By the selective erase address discharge, the discharge cell PC is set into a state where the wall charges of the positive polarity have been formed near each of the row electrodes Y and X and the wall charges of the negative polarity have been formed near the column electrode D, that is, into the turn-off mode. The selective erase address discharge as mentioned above is not caused between the column electrode D and the row electrode Y in the discharge cell PC to which the pixel data pulses DP of the low voltage (0 volt) has been applied simultaneously with the erase scanning pulse $SP_D$. The discharge cell PC, therefore, maintains the state just before it (the turn-on mode, turn-off mode).

In the sustaining step I of each of the subfields SF3 to SF14, the X-electrode driver 51 and the Y-electrode driver 53 alternately repeat the process the number of times corresponding to the luminance weight of the subfield with respect to the row electrodes Y and X as shown in FIG. 8 and apply the sustaining pulse IP having the peak electric potential of the positive polarity to the row electrodes $Y_1$ to $Y_n$ and the row electrodes $X_1$ to $X_n$, respectively. Each time the sustaining pulse IP is applied, the sustain discharge is caused between the row electrodes X and Y in the discharge cell PC which has been set into the turn-on mode. The light emitted from the phosphor layer 17 in association with the sustain discharge is irradiated to the outside through the front transparent substrate 10, so that the display light emission is performed the number of times corresponding to the luminance weight of the subfield SF. The total number of sustaining pulses IP which are repetitively applied in each sustaining step I is equal to an even number. In each sustaining step I, therefore, the head sustaining pulse IP is applied to the row electrode X and the last sustaining pulse IP is applied to the row electrode Y. Just after each sustaining step I, consequently, the wall charges of the negative polarity are formed near the row electrode Y in the discharge cell PC in which the sustain discharge has been caused and the wall charges of the positive polarity are formed near each of the row electrode X and the column electrode D, respectively. That is, the forming state of the wall charges in each discharge cell PC is substantially the same as that just after the first reset discharge.

After completion of the sustaining step I of the last subfield SF14, the Y-electrode driver 53 applies an erasing pulse EP having a peak electric potential of the negative polarity to all of the row electrodes $Y_1$ to $Y_n$. An erase discharge is caused only in the discharge cells PC which are in the turn-on mode state in accordance with the applying of the erasing pulse EP. The discharge cells PC which have been in the turn-on mode state are shifted to the turn-off mode state by the erase discharge.

In the case of a PDP having excellent discharging characteristics like a PDP in which the CL light-emission MgO crystal is contained in both of the magnesium oxide layer 13 and the phosphor layer 17 as shown in FIG. 3, there is also a case where even if the positive polarity peak electric potential of the reset pulse $RP2_{Y1}$ is set to a value which is equal to or less than the positive polarity peak electric potential of the sustaining pulse IP, the first reset discharge is correctly caused. In the above case, if the positive polarity peak electric potential of the reset pulse $RP2_{Y1}$ is set to a value which is equal to or less than the positive polarity peak electric potential of the sustaining pulse IP, it is desirable because a dark contrast is improved. Similarly, in the case where the second reset discharge is correctly caused even if an absolute value of the negative polarity peak electric potential of the reset pulse $RP2_{Y2}$ is set to a value which is equal to or less than an absolute value of the positive polarity peak electric potential of the sustaining pulse IP, it is preferable that the absolute value of the negative polarity peak electric potential of the reset pulse $RP2_{Y2}$ is set to a value which is equal to or less than the absolute value of the positive polarity peak electric potential of the sustaining pulse IP.

[Second Driving Pulse Applying Sequence GTS2]

In the second driving pulse applying sequence GTS2 shown in FIG. 9, other operations excluding a point that in place of $RP2_{Y1}$ shown in FIG. 8, $RP2_{Y1A}$ is used as a reset pulse to be applied to each of the row electrodes $Y_1$ to $Y_n$ in the former half portion of the second resetting step R2 of the subfield SF2 are substantially the same as those shown in FIG. 8.

Only the operation for applying the reset pulse $RP2_{Y1A}$ in the former half portion of the second resetting step R2 shown in FIG. 9, therefore, will be described hereinbelow.

In FIG. 9, in the former half portion of the second resetting step R2, the X-electrode driver 51 applies the reset pulse $RP2_X$ having such a waveform that its electric potential rises gently from the state of the grounding potential (0 volt) and reaches a predetermined positive polarity peak electric potential to each of all of the row electrodes $X_1$ to $X_n$. The reset pulse $RP2_X$ is applied in order to prevent the discharge between the row electrodes X and Y in the former half portion of the second resetting step R2. While the reset pulse $RP2_X$ is applied to each of the row electrodes $X_1$ to $X_n$, the address driver 55 sets the column electrodes $D_1$ to $D_m$ into the state of the grounding potential (0 volt). For the period of time, the Y-electrode driver 53 further applies the reset pulse $RP2_{Y1A}$ having such a waveform that its electric potential rises gently from the state of the grounding potential (0 volt) and reaches a predetermined positive polarity peak electric potential to the row electrodes $Y_1$ to $Y_n$. In the case of a leading waveform in the reset pulse $RP2_{Y1A}$, a potential shift in a leading edge portion with the elapse of time is gentler as compared with that of the sustaining pulse IP. The positive polarity peak electric potential of the reset pulse $RP2_{Y1A}$ is lower than the positive polarity peak electric potential of the reset pulse $RP2_{Y1}$ which is applied to the row electrode Y in the second resetting step R2 of the first driving pulse applying sequence GTS1 (shown in FIG. 8). The peak electric potential of the positive polarity of the reset pulse $RP2_{Y1A}$ has been set to such an electric potential that the voltage developed between the row electrode Y and the column electrode D by the applying of that electric potential is lower than the discharge start voltage. In the second resetting step R2 of the second driving pulse applying sequence GTS2 as shown in FIG. 9, therefore, unlike the second resetting step R2 of the first driving pulse applying sequence GTS1, no discharge (reset discharge) is caused not only between the row electrodes X and Y but also between the row electrode Y and the column electrode D.

[Third Driving Pulse Applying Sequence GTS3]

In the third driving pulse applying sequence GTS3 shown in FIG. 10, other operations excluding the pulse applying operation in the former half portion of the second resetting step R2 of the subfield SF2 are substantially the same as those shown in FIG. 8.

Only the pulse applying operation in the former half portion of the second resetting step R2 shown in FIG. 9, therefore, will be described hereinbelow.

In FIG. 10, in the former half portion of the second resetting step R2, the X-electrode driver 51 applies the reset pulse $RP2_X$ having such a waveform that its electric potential rises gradually from the state of the grounding potential (0 volt) with the elapse of time and reaches the positive polarity peak electric potential to each of all of the row electrodes $X_1$ to $X_n$. While the reset pulse $RP2_X$ is applied to the row electrodes $X_1$ to $X_n$, the Y-electrode driver 53 continuously applies the positive polarity peak electric potential, as it is, in the micro light-emitting pulse LP applied to all of the row electrodes Y in the micro light-emitting step LL at the front stage to the row electrodes $Y_1$ to $Y_n$. That is, in the former half portion of the second resetting step R2, unlike the case of the second resetting step R2 of each of the first driving pulse applying sequence GTS1 and the second driving pulse applying sequence GTS2, the reset pulse ($RP2_{Y1}$, $RP2_{Y1A}$) is not applied. Although the micro light-emitting discharge is, therefore, caused in the discharge cell PC which has been set into the turn-on mode in accordance with the applying of the micro light-emitting pulse LP in a manner similar to the case of the first driving pulse applying sequence GTS1, no discharge is caused in the discharge cell PC which has been set into the turn-off mode. In brief, in the former half portion of the second resetting step R2 in the third driving pulse applying sequence GTS3, no reset discharge is caused in a manner similar to the case of the former half portion of the second resetting step R2 in the second driving pulse applying sequence GTS2.

In the plasma display apparatus according to the invention, the driving as mentioned above (FIGS. 7 to 11) is executed on the basis of the 16 kinds of pixel drive data GD shown in FIG. 6, thereby allowing each discharge cell PC to emit the light at the luminance levels of 16 gradations.

First, at the second gradation showing the luminance which is higher by one level than the first gradation expressing the black display (luminance level 0), as shown in FIG. 6, the selective write address discharge to set the discharge cell PC into the turn-on mode is caused only in SF1 among the subfields SF1 to SF14, thereby allowing the discharge cell PC set into the turn-on mode to execute the micro light-emitting discharge (shown by □). At this time, the luminance level upon light emission accompanied by the selective write address discharge and the micro light-emitting discharge is lower than the luminance level upon light emission accompanied by the sustain discharge of one time. When the luminance level which is visually sensed by the sustain discharge is assumed to be "1", at the second gradation, the luminance corresponding to a luminance level "α" lower than the luminance level "1" is expressed. At the third gradation showing the luminance which is higher than the second gradation by one level, the selective write address discharge to set the discharge cell PC into the turn-on mode is caused only in SF2 among the subfields SF1 to SF14 (shown by ◎) and the selective erase address discharge to shift the discharge cell PC into the turn-off mode is caused in the next subfield SF3 (shown by ●). At the third gradation, therefore, the light emission accompanied by the sustain discharge of one time is performed only in the sustaining step I of SF2 among the subfields SF1 to SF14 and the luminance corresponding to the luminance level "1" is expressed. At the fourth gradation showing the luminance which is higher than the third gradation by one level, first, the selective write address discharge to set the discharge cell PC into the turn-on mode is caused in the subfield SF1, thereby allowing the discharge cell PC set into the turn-on mode to execute the micro light-emitting discharge (shown by □). Further, at the fourth gradation, the selective write address discharge to set the discharge cell PC into the turn-on mode is caused only in SF2 among the subfields SF1 to SF14 (shown by ◎) and the selective erase address discharge to shift the discharge cell PC into the turn-off mode is caused in the next subfield SF3 (shown by ●). At the fourth gradation, therefore, since the light emission of luminance level "α" is performed in the subfield SF1 and the sustain discharge accompanied with the light emission of luminance level "1" is performed only once in SF2, the luminance corresponding to the luminance level "α"+"1" is expressed. At each of the 5th to 16th gradations, the selective write address discharge to set the discharge cell PC into the turn-on mode is caused in the subfield SF1, thereby allowing the discharge cell PC set into the turn-on mode to execute the micro light-emitting discharge (shown by □). The selective erase address discharge to shift the discharge cell PC into the turn-off mode is caused only in the one subfield corresponding to the gradation (shown by ●). At each of the 5th to 16th gradations, therefore, after the micro light-emitting discharge was caused in the subfield SF1 and the sustain discharge of one time was caused in SF2, in each of the continuous subfields (shown by ○) of the number corresponding to the gradations, the sustain discharge is caused the number of times allocated to the subfield. At each of the 5th to 16th gradations, therefore, the luminance corresponding to the luminance level "α"+"the total number of sustain discharges caused within the unit display period" is visually sensed. According to the driving as mentioned above, therefore, a luminance range of the luminance levels "0" to "255+α" can be expressed by sixteen levels as shown in FIG. 6. At this time, according to the driving, in the subfield SF1 in which the luminance weight is smallest, the micro light-emitting discharge is caused as a discharge which contributes to the display image in place of the sustain discharge. Since the micro light-emitting discharge is a discharge which is caused between the column electrode D and the row electrode Y, the luminance level upon light emission accompanied by the discharge is lower than that of the sustain discharge which is caused between the row electrodes X and Y. When the luminance which is higher than the black display (luminance level 0) by one level (second gradation) is expressed by the micro light-emitting discharge, therefore, a luminance difference from the luminance level 0 is smaller than that in the case of expressing the high luminance by the sustain discharge. Gradation expressing ability, therefore, at the time of expressing the low luminance image is raised. At the second gradation, since no reset discharge is caused in the second resetting step R2 of SF2 subsequent to the subfield SF1, a decrease in dark contrast due to the reset discharge is suppressed. In the driving shown in FIG. 6, although the micro light-emitting discharge accompanied with the light emission of the luminance level α is caused in the subfield SF1 even at each gradation subsequent to the fourth gradation, it is also possible to construct in such a manner that the micro light-emitting discharge is not caused at the gradations subsequent to the third gradation. In brief, this is because since the light emission accompanied by the micro light-emitting discharge is executed at the extremely low luminance (luminance level α), at the gradations subsequent to the fourth gradation at which the micro light-emitting discharge is executed together with the sustain discharge accompanied with the light emission of the luminance higher than the low luminance (luminance level α), there is a case where the increased amount of luminance of the luminance level α cannot be visually sensed, and it is meaningless to cause the micro light-emitting discharge in this instance.

In the plasma display apparatus shown in FIG. 1, there is mounted the PDP 50 constructed in such a manner that by allowing the CL light-emission MgO crystal to be contained in both of the magnesium oxide layer 13 and the phosphor layer 17 as shown in FIG. 3, a discharge probability is extremely raised as compared with that of the PDP in the related art and the shortage of a discharge time lag and the weakening of the discharge are realized. According to the PDP 50, since the weakened reset discharge can be certainly caused, the light emission accompanied by the reset discharge which is not concerned with the display image is suppressed and the contrast of the image, particularly, the dark contrast at the time of displaying a dark image can be raised.

Figure 12:
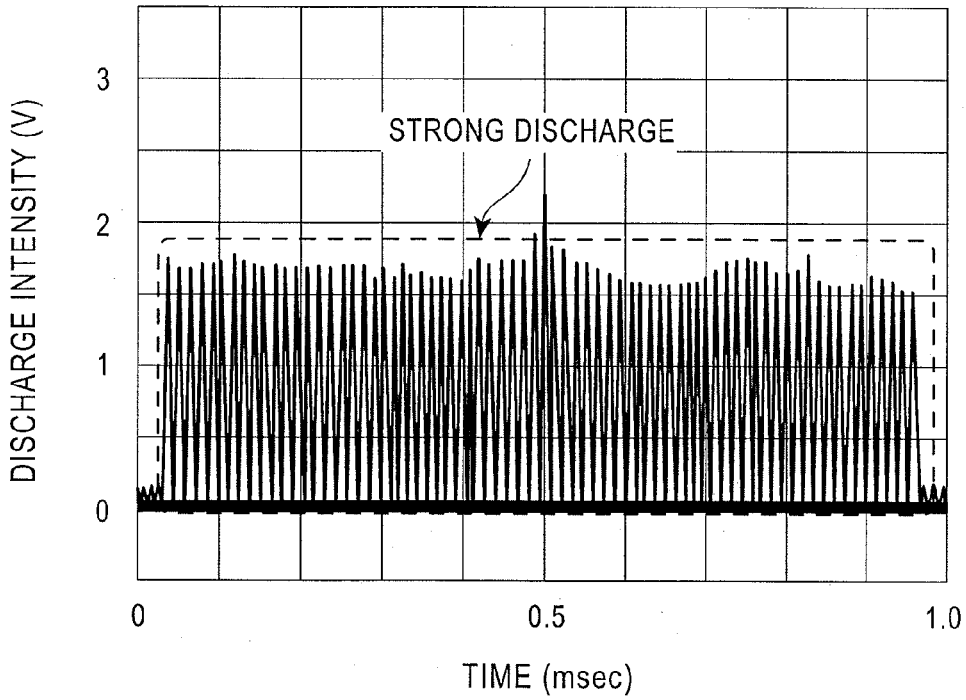
FIG. 12 is a diagram showing a transition of a discharge intensity in a PDP in the related art in which a CL light-emission MgO crystal is contained only in a magnesium oxide layer 13.
Figure 13:
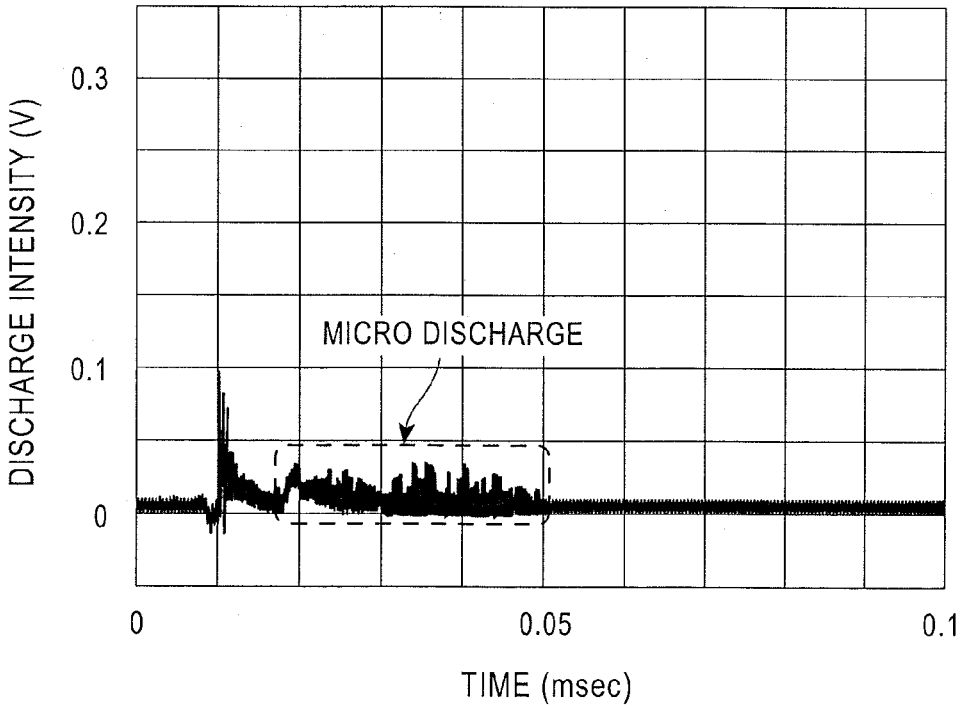
FIG. 13 is a diagram showing a transition of a discharge intensity in the PDP 50 in which the CL light-emission MgO crystal is contained in both of the magnesium oxide layer 13 and a phosphor layer 17.

FIG. 12 is a diagram showing a transition of a discharge intensity in the column-side cathode discharge which is caused in the PDP in the related art using a structure in which the CL light-emission MgO crystal is contained only in the magnesium oxide layer 13 in each of the magnesium oxide layer 13 and the phosphor layer 17 as mentioned above. FIG. 13 is a diagram showing a transition of a discharge intensity in the column-side cathode discharge which is caused in the PDP 50 in which the CL light-emission MgO crystal is contained in both of the magnesium oxide layer 13 and the phosphor layer 17.

As shown in FIG. 12, although the relatively strong column-side cathode discharge continues for 1 [msec] or longer according to the PDP in the related art, according to the PDP 50 of the invention, as shown in FIG. 13, the column-side cathode discharge is terminated within about 0.04 [msec]. That is, the discharge time lag in the column-side cathode discharge can be remarkably shortened as compared with that in the PDP in the related art. If the column-side cathode discharge is caused between the row electrode Y and the column electrode D of the PDP 50, therefore, the discharge is terminated before the electric potential of the row electrode Y reaches the peak electric potential of the pulse. That is, since the column-side cathode discharge is terminated at the stage where the voltage which is applied between the row electrode and the column electrode is low, as shown in FIG. 13, its discharge intensity also largely decreases as compared with that in the case of FIG. 12. Since the column-side cathode discharge whose discharge intensity is extremely weak can be caused as a reset discharge as mentioned above, the contrast of the image, particularly, the dark contrast at the time of displaying a dark image can be raised. Even in a PDP in which magnesium oxide containing no CL light-emission MgO crystal is contained in the phosphor layer 17, a result in which the discharge intensity is large in a manner similar to FIG. 12 is obtained.

Further, if a structure in which the CL light-emission MgO crystal is contained in both of the magnesium oxide layer 13 and the phosphor layer 17 is used as a PDP 50, even if an amount of charged particles remaining in each discharge cell PC is small, the discharge can be certainly caused. Even if an opportunity (second resetting step R2 of GTS1) adapted to cause the first reset discharge serving as a relatively strong discharge in order to form the charged particles is reduced, the selective write address discharge can be certainly caused in the subsequent second selective write addressing step $W2_W$.

In the plasma display apparatus shown in FIG. 1, the driving according to the first driving pulse applying sequence GTS1 in which the first reset discharge as mentioned above is performed in the unit display period and the driving according to the second or third driving pulse applying sequence GTS2 or GTS3 in which the first reset discharge is not caused are alternately executed every unit display period. For example, in FIG. 11, the first driving pulse applying sequence GTS1 in which the first reset discharge is performed is used in the first and third fields and the third driving pulse applying sequence GTS3 without the first reset discharge is used in the second and fourth fields. Further, when the first driving pulse applying sequence GTS1 is used in each of the first and third fields, the driving according to the second driving pulse applying sequence GTS2 without the first reset discharge is executed to a group of the odd-number designated display lines in the first field and to a group of the even-number designated display lines in the third field. When each discharge cell PC is seen every display line, thus, the first reset discharge is caused at a rate of once per three continuous fields.

As compared with the case where the driving which causes the first reset discharge is used every field for all of the display lines as targets, therefore, a frequency of the first reset discharge per unit time decreases, the light emission luminance which is visually sensed decreases in association with the first reset discharge, and the contrast of the display screen is improved. As shown in FIG. 11, in the first field (third field), the first reset discharge is not caused in the discharge cells PC belonging to the odd-number designated display line group (even-number designated display line group). At this time, however, the charged particles are also supplemented to the discharge cells PC belonging to the odd-number designated display line group (even-number designated display line group) by the first reset discharge caused in the discharge cells PC belonging to the even-number designated display line group (odd-number designated display line group).

According to the driving as mentioned above, therefore, the contrast can be improved without decreasing the address discharge probability.

As shown in FIG. 11, by periodically and repetitively executing the driving constructed by

- the first field: there is no first reset discharge only in the odd-number designated display line group,
- the second field: there is no first reset discharge in all display lines,
- the third field: there is no first reset discharge only in the even-number designated display line group, and
- the fourth field: there is no first reset discharge in all display lines, a flicker due to a thin-out of the first reset discharge can be made inconspicuous to the viewer and the dark contrast can be improved as compared with the case where the fields having no first reset discharge are merely executed every plural fields.

In the former half portion of the second resetting step R2 of the third driving pulse applying sequence GTS3 (shown in FIG. 10) in which there is no first reset discharge in all of the display lines, a pulse width of the micro light-emitting pulse LP is increased by such an amount that no reset pulse is applied to each row electrode Y. The discharge cells PC which have been set into the turn-on mode state, therefore, can be made to certainly cause the micro light-emitting discharge in the subfield SF1 in response to the micro light-emitting pulse LP. Even if the micro light-emitting pulse LP is merely applied, no discharge is caused in the discharge cells PC which have been set into the turn-off mode state in SF1.

When the reset pulses $RP2_{Y1}$ and $RP2_{Y1A}$ which are applied to the row electrode Y are formed in the second resetting step R2 of the subfield SF2, respectively, the Y-electrode driver 53 forms the reset pulse $RP2_{Y1}$ by adding the positive polarity peak electric potential of the base pulse $BP^+$ to be applied in the selective erase addressing step $W_D$ to the reset pulse $RP2_{Y1A}$. The Y-electrode driver 53, therefore, can form the reset pulses $RP2_{Y1}$ and $RP2_{Y1A}$, respectively, by a reset pulse circuit for forming the reset pulse $RP2_{Y1A}$ and a circuit for generating a pulse obtained by adding the positive polarity peak electric potential of the base pulse $BP^+$ to the formed reset pulse $RP2_{Y1A}$ as a reset pulse $RP2_{Y1}$. That is, since the reset pulse circuit can be shared when the reset pulses $RP2_{Y1}$ and $RP2_{Y1A}$ are formed, respectively, its circuit construction is simplified.

Although the driving without the first reset discharge is executed to the discharge cells PC belonging to the odd-number designated display line group in the first field and to the discharge cells PC belonging to the even-number designated display line group in the third field, respectively, in the embodiment shown in FIG. 11, the display line groups serving as targets of the driving without the first reset discharge are not limited to the even-number designated and odd-number designated layout units.

Figure 14:
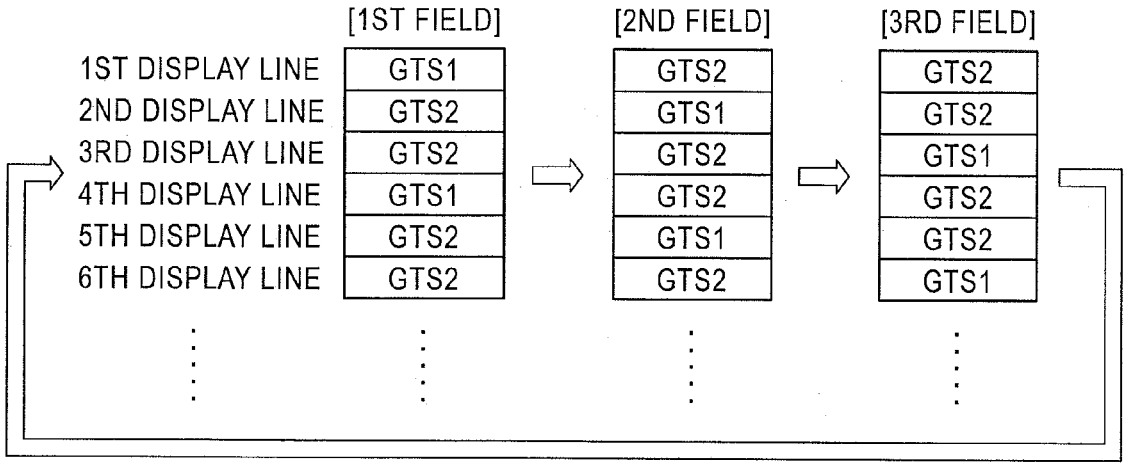
FIG. 14 is a diagram showing an example of a driving form of each display line according to a 3-field period.

For example, as shown in FIG. 14, it is also possible to periodically and repetitively execute such a driving that every display line groups each of which is constructed by three adjacent display lines, the display lines serving as targets of the driving having the first reset discharge in the display line group are switched every field as follows.

The first field: The first reset discharge exists only in the (3·k−2)th display line The second field: The first reset discharge exists only in the (3·k−1)th display line The third field: The first reset discharge exists only in the (3·k)th display line Where, k: integer of 1 to (n/3)

Figure 15:
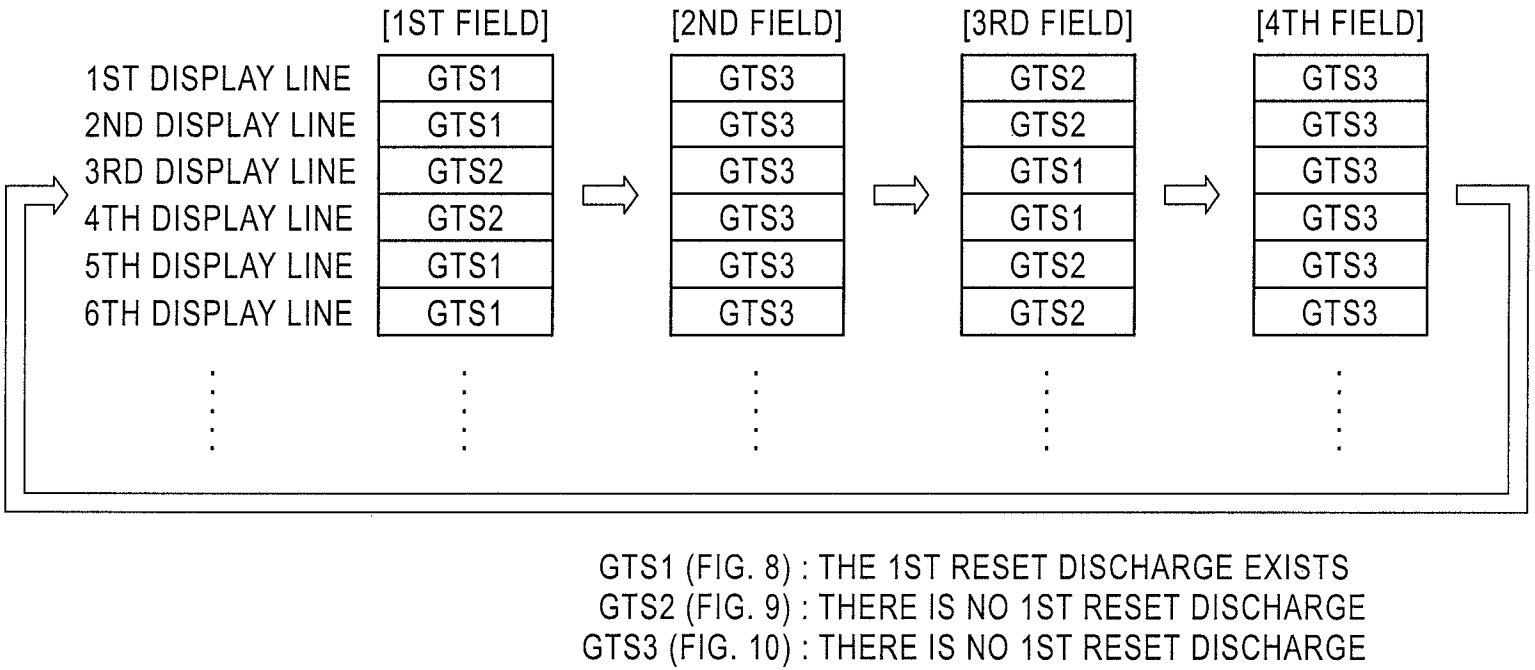
FIG. 15 is a diagram showing another example of the driving form of each display line according to the 4-field period.

As shown in FIG. 15, it is also possible to periodically and repetitively execute such a driving that in display line group units each of which is constructed by two adjacent display lines, a mode in which each of the display lines belonging to the display line group is set to a target of the driving having the first reset discharge and a mode in which each of the display lines belonging to the display line group is set to a target of the driving without the first reset discharge are switched every field as follows.

The first field: The first reset discharge exists only in the (4·k−3)th and (4·k−2)th display lines The second field: There is no first reset discharge in all display lines The third field: The first reset discharge exists only in the (4·k−1)th and (4·k)th display lines The fourth field: There is no first reset discharge in all display lines Where, k: integer of 1 to (n/4)

Figure 16:
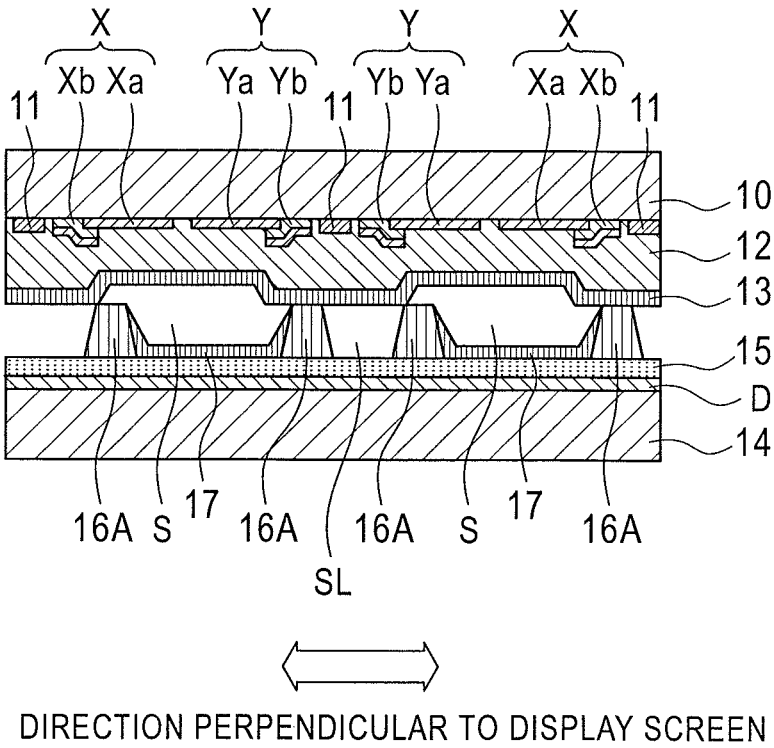
FIG. 16 is a diagram showing a structure of the PDP which is optimum in the case of using the driving form shown in FIG. 15.

According to the driving as shown in FIG. 14 or 15 as mentioned above, the flicker which is caused in association with the thin-out of the first reset discharge can be made inconspicuous. Further, according to the driving shown in FIG. 15, even if a PDP having the following structure is used, the occurrence of the flicker can be suppressed. That is, in the PDP having such a structure that a layout pattern of the row electrodes X and Y is set to [X-Y-Y-X-X-Y-Y-X] and the positions where the row electrodes X and Y are arranged are deviated in the vertical direction of the display screen as shown in FIG. 16 from a discharge space S of each discharge cell PC, with respect to the adjacent display lines, a difference occurs in each facing area between the row electrode Y and the column electrode D through the discharge space S. With respect to the adjacent display lines, therefore, discharge intensities of the first reset discharge which is caused between the row electrode Y and the column electrode D differ. If the driving as shown in FIG. 11 is executed to the PDP having the above structure, consequently, a difference occurs between the light emission luminance accompanied by the first reset discharge with respect to the odd-number designated display lines and the even-number designated display lines. The luminance difference is visually sensed as a flicker, particularly, when a dark image is displayed. If the driving shown in FIG. 15 is executed in place of FIG. 11, however, since both of the odd-number designated display lines and the even-number designated display lines which are neighboring each other are always set into the state having the first reset discharge or the state without the first reset discharge, the flicker as mentioned above is suppressed.

Although the third driving pulse applying sequence GTS3 shown in FIG. 10 is used when the driving without the first reset discharge is executed to all of the display lines (the second and third fields) in the embodiment shown in FIGS. 11 and 15, the second driving pulse applying sequence GTS2 shown in FIG. 9 may be used in place of GTS3.

Figure 17:
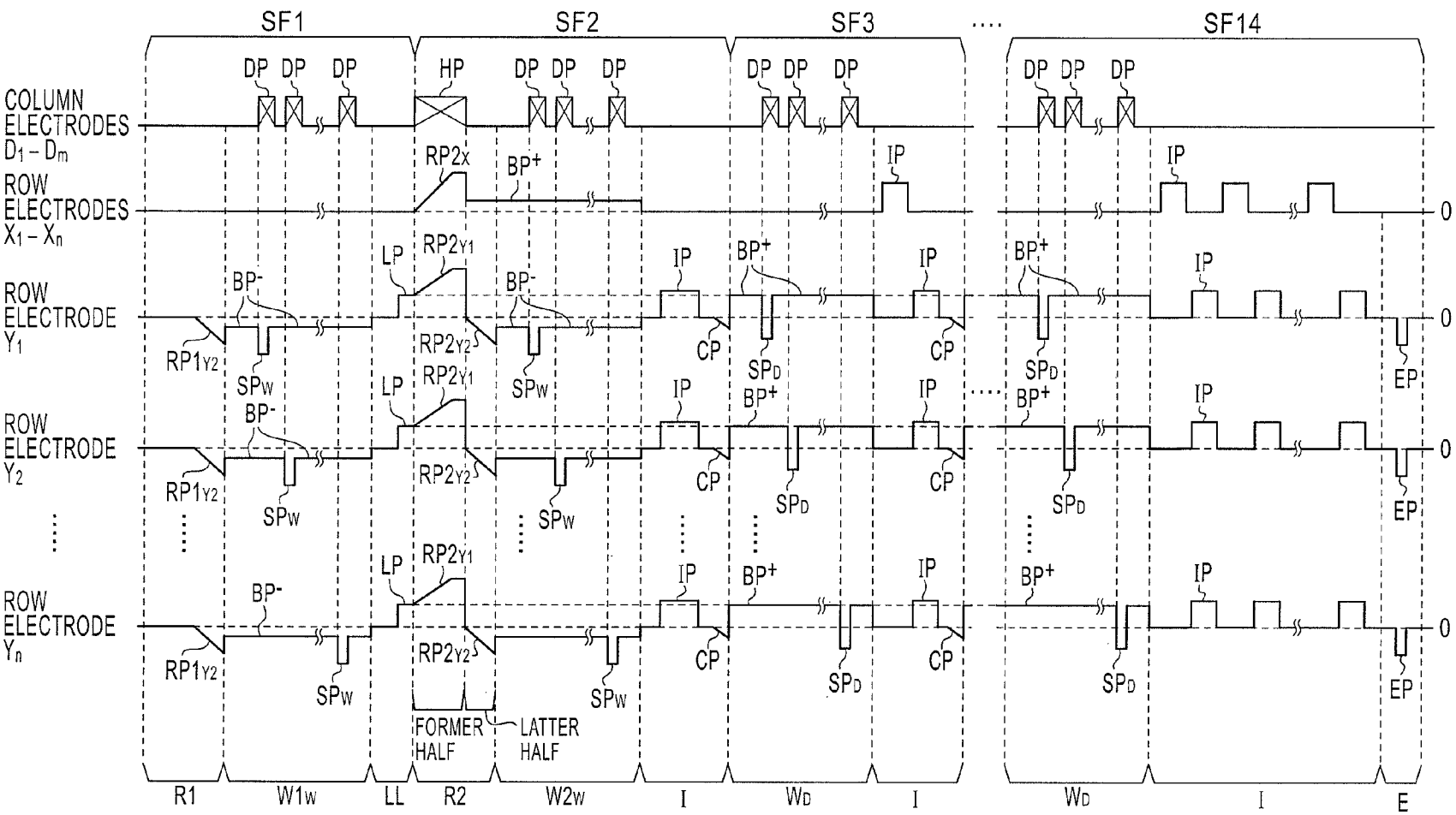
FIG. 17 is a diagram showing a modification of the first driving pulse applying sequence GTS1.

Although the state having the first reset discharge and the state without the first reset discharge have been controlled on a display line unit basis in the above embodiment, they can be also controlled on a column unit basis. In this instance, a sequence shown in FIG. 17 in place of FIG. 8 is used as a first driving pulse applying sequence GTS1 for executing the driving having the first reset discharge. In FIG. 17, since other applying operations excluding a point that an auxiliary pulse HP is applied to the column electrode D in the former half portion of the second resetting step R2 of the subfield SF2 are substantially the same as those shown in FIG. 8, only the operation which is executed in accordance with the applying of the auxiliary pulse HP will be described hereinbelow.

In the former half portion of the second resetting step R2 of the first driving pulse applying sequence GTS1 shown in FIG. 17, the address driver 55 selectively applies the auxiliary pulse HP having a peak electric potential of the same polarity (positive polarity) as that of the reset pulse $RP2_{Y1}$ to each of the column electrodes $D_1$ to $D_m$ at the same timing as that for the reset pulse $RP2_{Y1}$. In this instance, the electric potential on the column electrode D to which the auxiliary pulse HP is not applied is held at the grounding potential (0 volt). In the discharge cell PC on the column electrode D to which the auxiliary pulse HP is not applied, although the first reset discharge is caused in response to the reset pulse $RP2_{Y1}$ applied to the row electrode Y, since a voltage between the column electrode D and the row electrode Y in the discharge cell PC on the column electrode D to which the auxiliary pulse HP has been applied is less than the discharge start voltage, the first reset discharge is not caused.

As mentioned above, by using the first driving pulse applying sequence GTS1 shown in FIG. 17, the first reset discharges can be further thinned out on a column unit basis in the PDP 50, that is, on a color unit basis. For example, on the basis of the input video signal, the drive control circuit 56 discriminates whether or not the pixels of the number larger than a predetermined number adapted to display a pure color of red, green, blue, cyan, magenta, or yellow exist on each of the column groups each of which is constructed by three adjacent columns every field. If the "column group" in which the pixels of the number larger than the predetermined number adapted to display the pure color exist exists in one frame, the drive control circuit 56 detects the "column" corresponding to the discharge cells PC which exist on the "column group" and display black when the relevant pure color is displayed from one frame. The drive control circuit 56 supplies a control signal to the address driver 53 in order to apply the auxiliary pulse HP having the peak electric potential of the positive polarity to each of the column electrodes D belonging to the detected "column". According to the driving, since the first reset discharge whose discharge intensity is relatively large is not caused in the discharge cells PC in which the light emission is unnecessary, the image can be displayed at an increased color purity of the pure color display. Further, with respect to the discharge cells PC in which the black display is executed, since it is inherently unnecessary to cause the selective write address discharge adapted to set the discharge cell into the turn-on mode state, by efficiently performing the reset thin-out process to the column in which the number of those discharge cells PC is large as a target, the contrast at the time of displaying the pure color is improved.

Further, the column electrode D to which the auxiliary pulse HP is applied and the column electrode D to which the auxiliary pulse HP is not applied may be set every light-emitting color of the phosphor layer 17.

For example, if it is intended to supplement a lack of priming particles while reducing the luminance at the time of the black display, among the discharge cell PC for performing the red light emission (hereinbelow, referred to as a red cell), the discharge cell PC for performing the green light emission (hereinbelow, referred to as a green cell), and the discharge cell PC for performing the blue light emission (hereinbelow, referred to as a blue cell), the auxiliary pulse HP is applied only to the column electrodes D corresponding to the red cell and the green cell. That is, the auxiliary pulse HP is not applied to the column electrode D corresponding to the blue cell. In other words, in the case of the general PDP, since the blue cell emits the light at a luminance lower than those of the discharge cells of the other colors, by causing the first reset discharge only in the blue cell of the luminance lower than those of the discharge cells of the other colors, the lack of the priming particles is supplemented by the first reset discharge while reducing the luminance at the time of the black display.

A case where it is intended to uniform the accumulated discharge intensity of the first reset discharge which does not depend on a color arrangement is now considered as another example. In the case, for the column electrodes D corresponding to the red cell and the blue cell among the red cell, green cell, and blue cell, the number of fields to which the auxiliary pulse HP is applied is set to a slightly large value. For the column electrodes D corresponding to the green cell, however, the fields to which the auxiliary pulse HP is not applied is set to a value larger than those of the column electrodes D corresponding to the red cell and the blue cell. That is, for the column electrode D corresponding to the green cell, a frequency of occurrence of the fields to which the auxiliary pulse HP is not applied is set to a value larger than those of the column electrodes D corresponding to the red cell and the blue cell. In other words, in the case of the general PDP, there is such a tendency that the discharge is difficult to be caused in the discharge cell for performing the green light emission as compared with the discharge cells for performing the light emission of the other colors. By raising a frequency of occurrence of the first reset discharge of the green cell in which the discharge is difficult to be caused as compared with the other discharge cells, the accumulated discharge intensity of the first reset discharge can be uniformed.

Further, a pulse width of the auxiliary pulse HP may be changed every color arrangement.

For example, the pulse width of the auxiliary pulse HP which is applied to the column electrode corresponding to the blue cell is set to be shorter than that of the auxiliary pulse HP which is applied to each of the other column electrodes. In the case, the lack of the priming particles can be supplemented by the first reset discharge while reducing the luminance at the time of the black display.

The frequency of occurrence of the fields in which the pulse width of the auxiliary pulse HP which is applied to the column electrode corresponding to the green cell is set to be shorter than that of the auxiliary pulse HP which is applied to each of the other column electrodes is raised. Also in the case, the accumulated discharge intensity of the first reset discharge can be uniformed in a manner similar to that mentioned above.

In brief, the adjustment of a color tone, a luminance, and an amount of generated priming particles by the first reset discharge can be made by arbitrarily setting the presence or absence of the applying of the auxiliary pulse HP of each color arrangement and its pulse width.

Figure 18A:
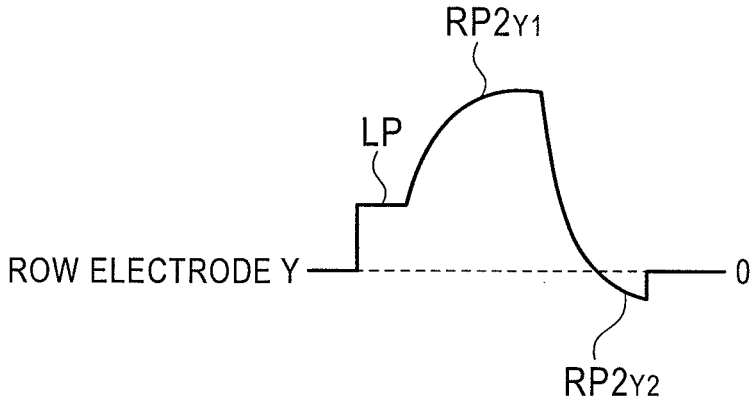
FIGS. 18A and 18B are diagrams showing other waveforms of reset pulses $RP2_{Y1}$ and $RP2_{Y1A}$.
Figure 18B:
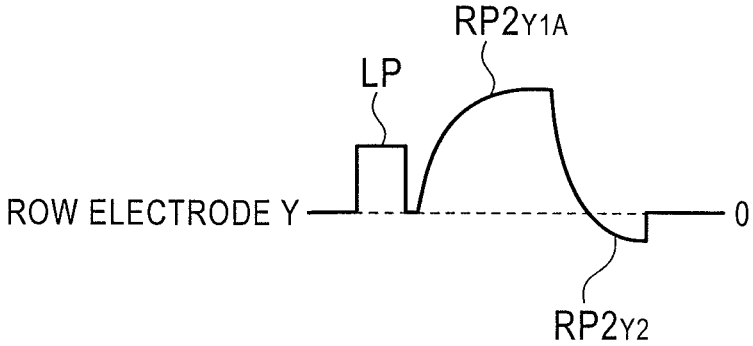
Figure 19:
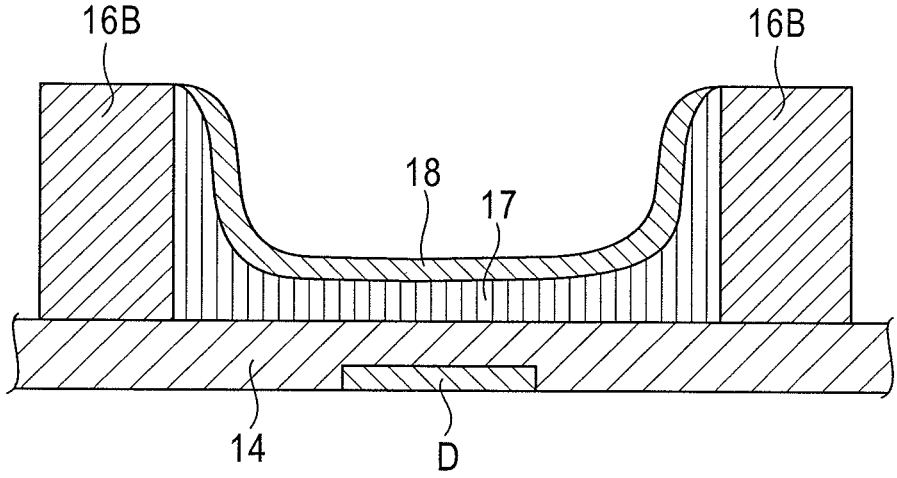
FIG. 19 is a diagram schematically showing a form in the case where a secondary electron emitting layer 18 is overlaid onto the surface of the phosphor layer 17.

In the embodiment, leading waveforms of the reset pulses $RP2_{Y1}$ and $RP2_{Y1A}$ which are applied to all of the row electrodes Y in the former half portion of the second resetting step R2 of the subfield SF2 are not limited to waveforms having predetermined inclinations as shown in FIGS. 8 and 9 but may be waveforms whose inclinations change gradually with the elapse of time as shown in FIGS. 18A and 18B.

Although the MgO crystal is contained in the phosphor layer 17 provided on the rear substrate 14 side of the PDP 50 in the embodiment shown in FIG. 5, a secondary electron emitting layer 18 made of a secondary electron emitting material may be provided so that the surface of the phosphor layer 17 is covered with it. In this instance, as a secondary electron emitting layer 18, a crystal made of the secondary electron emitting material (for example, MgO crystal containing a CL light-emission MgO crystal) may be formed on the surface of the phosphor layer 17 so that the surface is filled with the crystal, or the secondary electron emitting material can be also formed as a thin film.

Figure 20:
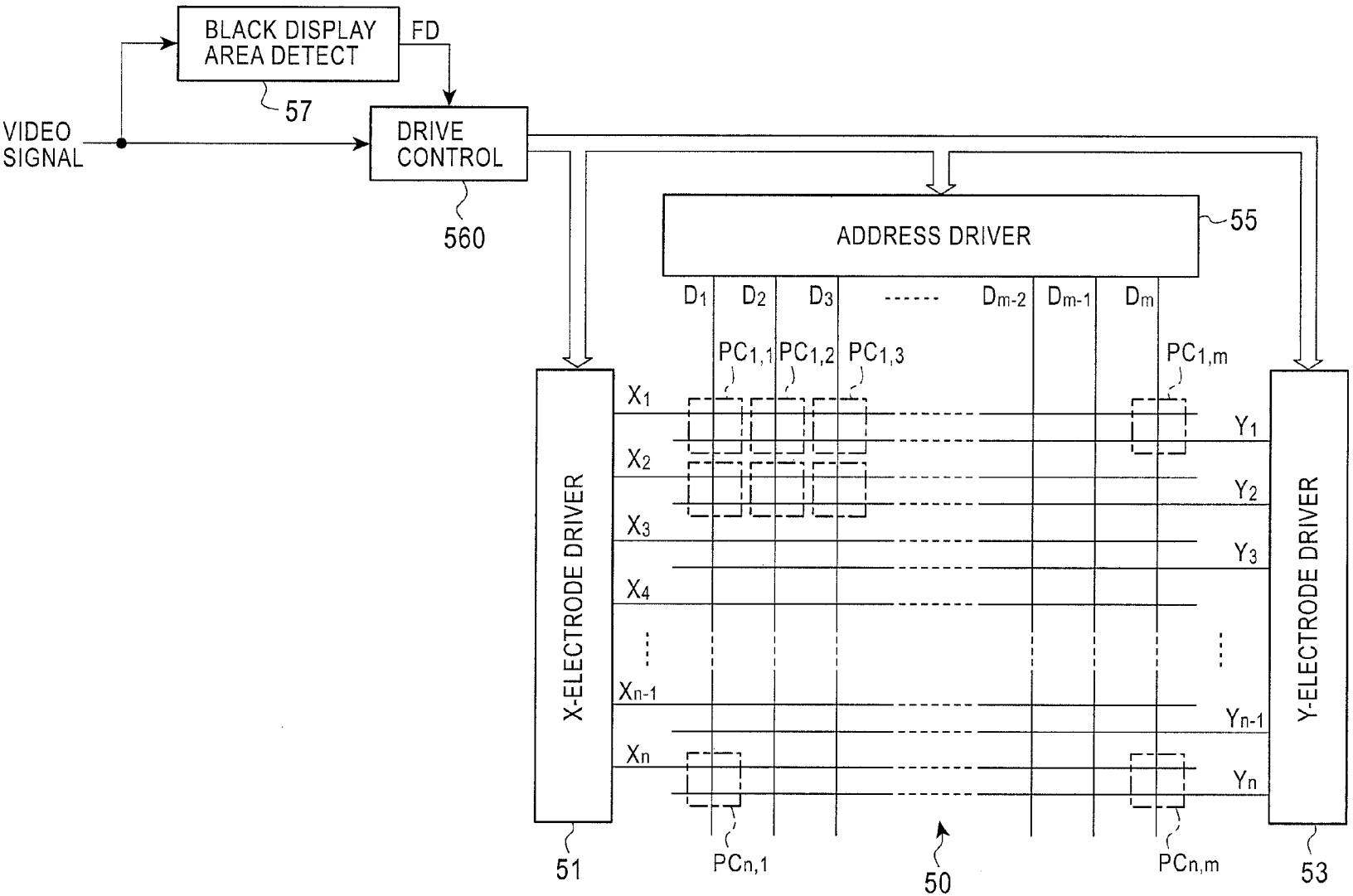
FIG. 20 is a diagram showing a schematic construction of a plasma display apparatus according to an embodiment 2 of the invention.

FIG. 20 is a diagram showing another construction of a plasma display apparatus for driving a plasma display panel by the driving method of the plasma display panel according to the invention.

Other constructions of the plasma display apparatus shown in FIG. 20 excluding a point that a drive control circuit 560 is used in place of the drive control circuit 56 and a black display area detecting circuit 57 is newly provided are substantially the same as those shown in FIG. 1. The operations of the black display area detecting circuit 57 and the drive control circuit 560, therefore, will be mainly described hereinbelow.

The black display area detecting circuit 57 detects an area of a black display portion existing in the image of each field (frame) on the basis of the input video signal and supplies black display area data FD showing the detected area to the drive control circuit 560.

In a manner similar to the drive control circuit 56, the drive control circuit 560 converts the input video signal every pixel into the 8-bit pixel data in which all luminance levels are expressed by 256 gradations and executes the multi-gradation forming process constructed by the error diffusing process and the dither process to the pixel data, thereby forming the 4-bit multi-gradation pixel data PDs in which all luminance level ranges are expressed by 16 gradations. Subsequently, the drive control circuit 560 converts the multi-gradation pixel data PDs into the pixel drive data GD in accordance with the data conversion table as shown in FIG. 6. The drive control circuit 560 makes the first to fourteenth bits in the pixel drive data GD correspond to the subfields SF1 to SF14, respectively, and supplies the bit digits corresponding to the subfields SF as pixel drive data bits to the address driver 55 every data of one display line (m bits).

In a manner similar to the drive control circuit 56, the drive control circuit 560 supplies the various kinds of control signals adapted to drive the PDP 50 to the panel driver constructed by the X-electrode driver 51, Y-electrode driver 53, and address driver 55 in accordance with the light-emission driving sequence as shown in FIG. 7. In this instance, the drive control circuit 560 controls the Y-electrode driver 53 in such a manner that the larger the area of the black display portion shown by the black display area data FD is, the more the total number of first reset discharges which should be caused per unit time (every Q continuous fields or frames) is reduced.

For example, when the area of the black display portion shown by the black display area data FD is smaller than a predetermined area V1, the drive control circuit 560 controls the panel driver so as to execute the driving according to the following driving pattern 1. When the area of the black display portion shown by the black display area data FD is larger than the area V1 and is smaller than a predetermined area V2, the drive control circuit 560 controls the panel driver so as to execute the driving according to the following driving pattern 2 in which the number of occurrence of the first reset discharge per unit period is set to be smaller than that in the driving pattern 1. When the area of the black display portion shown by the black display area data FD is larger than the area V2 and is smaller than a predetermined area V3, the drive control circuit 560 controls the panel driver so as to execute the driving according to the following driving pattern 3 in which the number of occurrence of the first reset discharge per unit period is set to be smaller than that in the driving pattern 2. When the area of the black display portion shown by the black display area data FD is larger than the area V3, the drive control circuit 560 controls the panel driver so as to execute the driving according to the following driving pattern 4 in which the number of occurrence of the first reset discharge per unit period is set to be smaller than that in the driving pattern 3.

Figure 21:
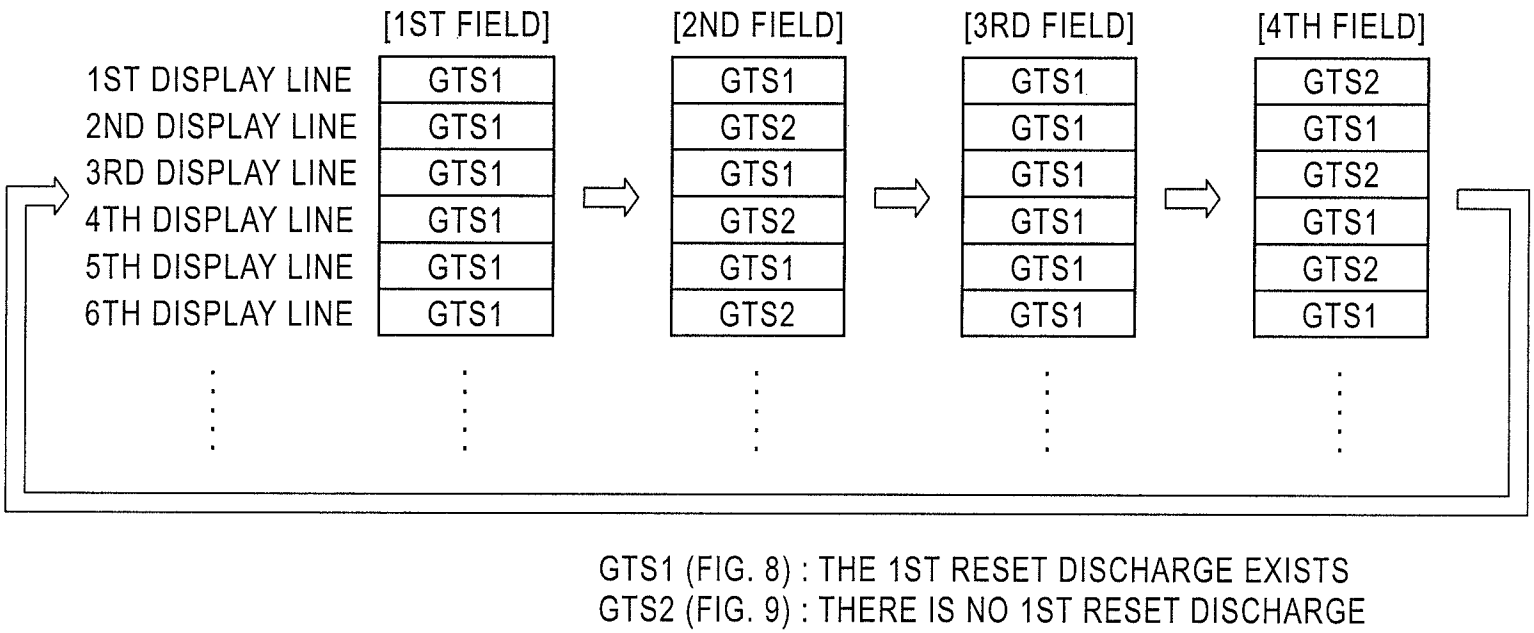
FIG. 21 is a diagram showing another example of the driving form of each display line according to the 4-field period.
Figure 22:
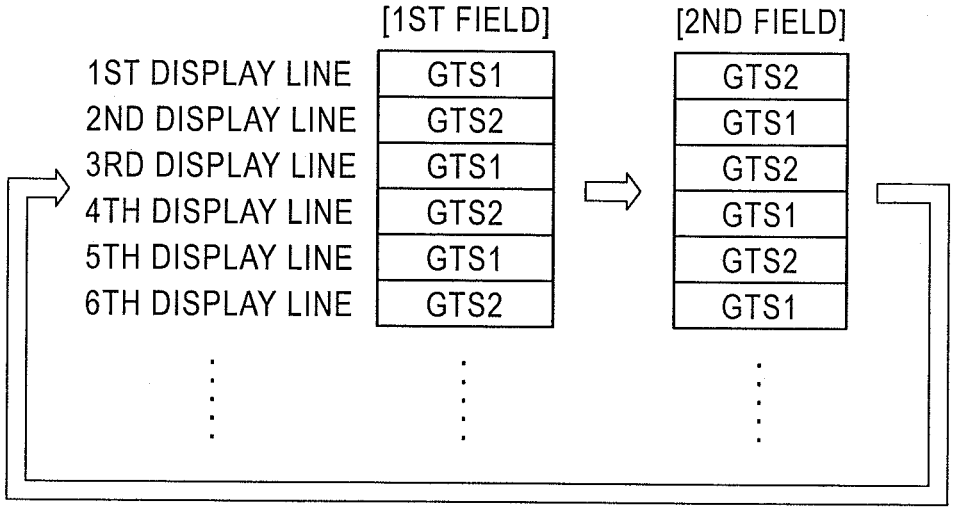
FIG. 22 is a diagram showing an example of a driving form of each display line according to a 2-field period.

Driving pattern 1: The driving according to GTS1 in all fields (frames) and all display lines Driving pattern 2: The driving of every four fields as shown in FIG. 21 is repetitively executed Driving pattern 3: The driving of every two fields as shown in FIG. 22 is repetitively executed Driving pattern 4: The driving of every four fields as shown in FIG. 11 is repetitively executed That is, when the dark contrast is raised, particularly, the larger the area of the black display portion existing in the image displayed in the display screen is, the higher an effect of improvement of picture quality which is sensed by the viewer is. The larger the black display area is, therefore, the more the number of first reset discharges to be thinned out is increased. The smaller the black display area is, the more the number of discharge cells PC in which the selective write address discharge should be caused in the second selective write addressing step $W2_W$ of the subfield SF2 is increased. In the case, therefore, by reducing the number of first reset discharges to be thinned out, an amount of priming particles which are formed is increased, thereby allowing the selective write address discharge to be certainly caused.

Figure 23:
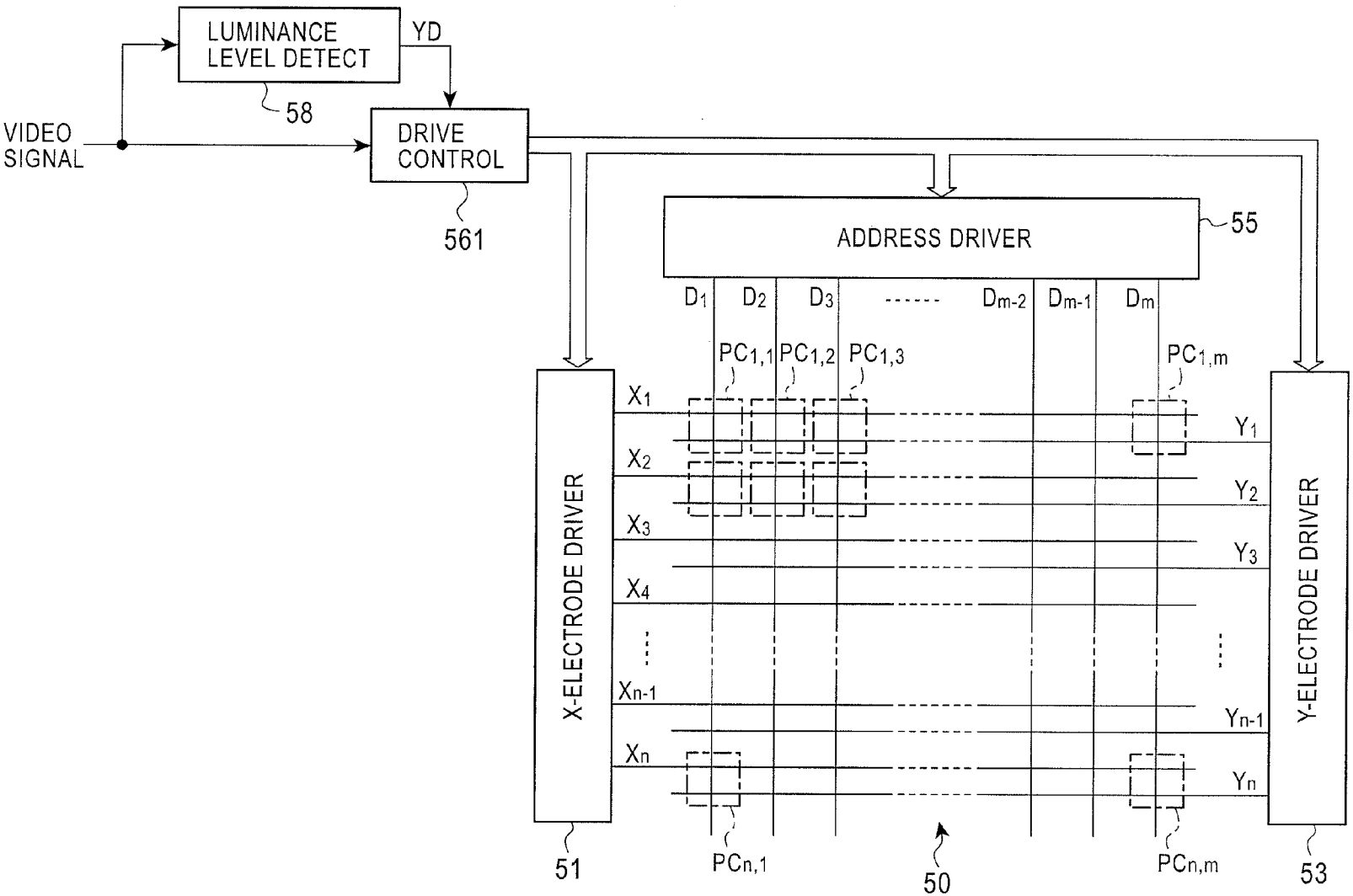
FIG. 23 is a diagram showing a schematic construction of a plasma display apparatus according to an embodiment 3 of the invention.

FIG. 23 is a diagram showing another construction of a plasma display apparatus for driving a plasma display panel according to the driving method of the plasma display panel according to the invention.

Other constructions of the plasma display apparatus shown in FIG. 23 excluding a point that a drive control circuit 561 is used in place of the drive control circuit 56 and a luminance level detecting circuit 58 is newly provided are substantially the same as those shown in FIG. 1. The operations of the luminance level detecting circuit 58 and the drive control circuit 561, therefore, will be mainly described hereinbelow.

The luminance level detecting circuit 58 detects an average luminance level of the whole image every field (frame) on the basis of the input video signal and supplies average luminance data YD showing the average luminance level to the drive control circuit 561.

In a manner similar to the drive control circuit 56, the drive control circuit 561 converts the input video signal every pixel into the 8-bit pixel data in which all of the luminance levels are expressed by 256 gradations, and executes the multi-gradation forming process constructed by the error diffusing process and the dither process to the pixel data, thereby forming the 4-bit multi-gradation pixel data PDs in which all of the luminance level ranges are expressed by 16 gradations. Subsequently, the drive control circuit 561 converts the multi-gradation pixel data PDs into the pixel drive data GD in accordance with the data conversion table as shown in FIG. 6. The drive control circuit 561 makes the 1st to 14th bits of the pixel drive data GD correspond to the subfields SF1 to SF14 and supplies bit digits corresponding to the subfields SF as pixel drive data bits to the address driver 55 every data of one display line (m bits).

The drive control circuit 561 supplies the various kinds of control signals adapted to drive the PDP 50 to the panel driver constructed by the X-electrode driver 51, Y-electrode driver 53, and address driver 55 in accordance with the light-emission driving sequence as shown in FIG. 7. At this time, the drive control circuit 561 controls the Y-electrode driver 53 in such a manner that the lower the average luminance level of the image shown by the average luminance data YD is, the more the total number of first reset discharges which should be caused per unit time (every Q continuous fields or frames) is reduced.

For example, when the average luminance level of the image shown by the average luminance data YD is higher than a predetermined luminance B1, the drive control circuit 561 controls the panel driver so as to execute the driving according to the following driving pattern 1. When the average luminance level of the image shown by the average luminance data YD is lower than the luminance B1 and is higher than a predetermined luminance B2, the drive control circuit 561 controls the panel driver so as to execute the driving according to the following driving pattern 2 in which the number of occurrence of the first reset discharge per unit period is set to be smaller than that in the driving pattern 1. When the average luminance level of the image shown by the average luminance data YD is lower than the luminance B2 and is higher than a predetermined luminance B3, the drive control circuit 561 controls the panel driver so as to execute the driving according to the following driving pattern 3 in which the number of occurrence of the first reset discharge per unit period is set to be smaller than that in the driving pattern 2. When the average luminance level of the image shown by the average luminance data YD is lower than the luminance B3, the drive control circuit 561 controls the panel driver so as to execute the driving according to the following driving pattern 4 in which the number of occurrence of the first reset discharge per unit period is set to be smaller than that in the driving pattern 3.

Driving pattern 1: The driving according to GTS1 in all fields (frames) and all display lines Driving pattern 2: The driving of every four fields as shown in FIG. 21 is repetitively executed Driving pattern 3: The driving of every two fields as shown in FIG. 22 is repetitively executed Driving pattern 4: The driving of every four fields as shown in FIG. 11 is repetitively executed That is, when the dark contrast is raised, particularly, when the darker image is displayed, the higher the effect of improvement of the picture quality which is sensed by the viewer is. The lower the average luminance level of the whole image is, therefore, the more the number of first reset discharges to be thinned out is increased. The higher the average luminance level of the whole image is, the more the number of discharge cells PC in which the selective write address discharge should be caused in the second selective write addressing step $W2_W$ of the subfield SF2 is increased. In the case, therefore, by reducing the number of first reset discharges to be thinned out, an amount of priming particles which are formed is increased, thereby allowing the selective write address discharge to be certainly caused.

Figure 24:
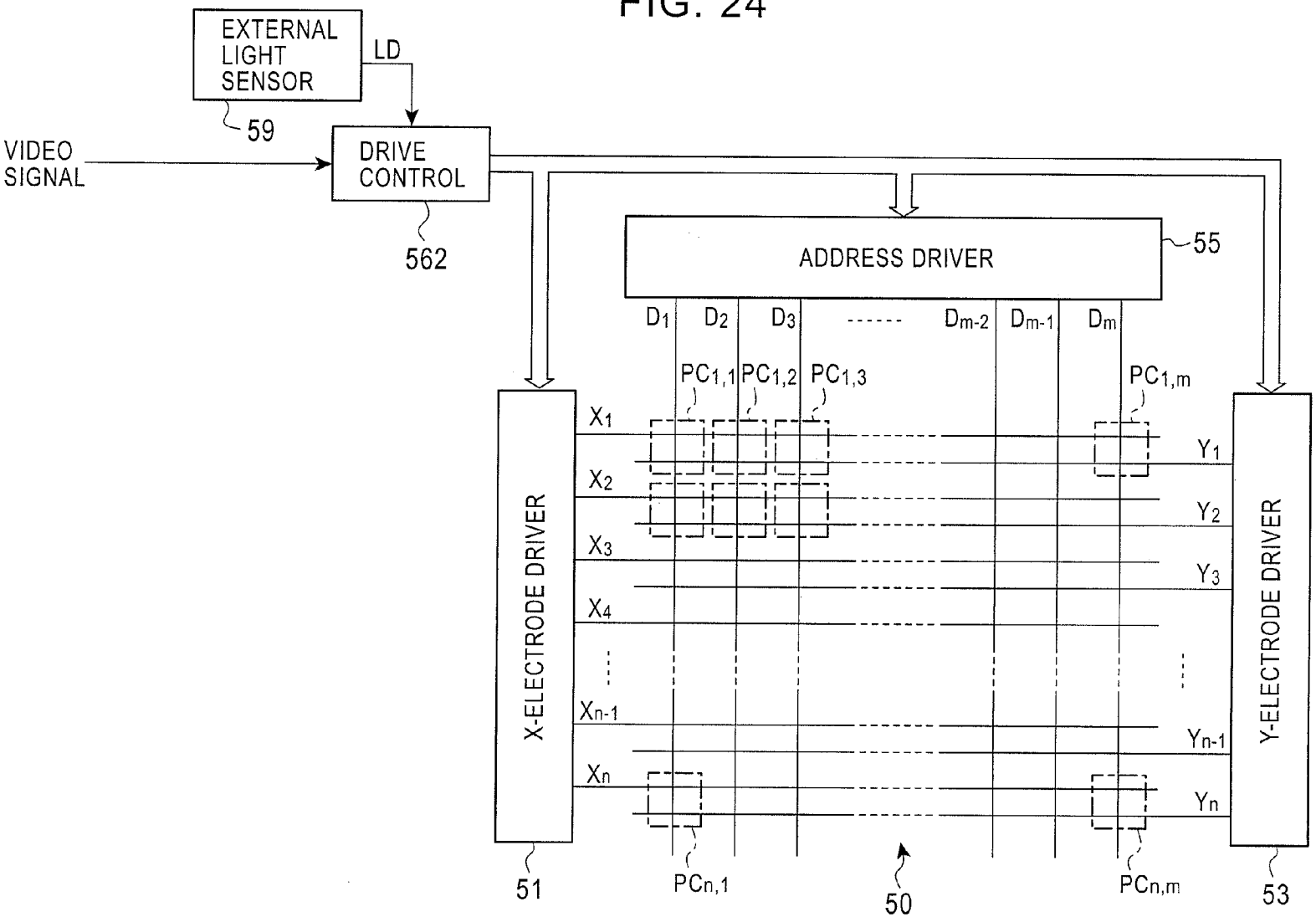
FIG. 24 is a diagram showing a schematic construction of a plasma display apparatus according to an embodiment 4 of the invention.

FIG. 24 is a diagram showing another construction of a plasma display apparatus for driving a plasma display panel according to the driving method of the plasma display panel according to the invention.

Other constructions of the plasma display apparatus shown in FIG. 24 excluding a point that a drive control circuit 562 is used in place of the drive control circuit 56 and an external light sensor 59 is newly provided are substantially the same as those shown in FIG. 1. The operations of the external light sensor 59 and the drive control circuit 562, therefore, will be mainly described hereinbelow.

Figure 25:
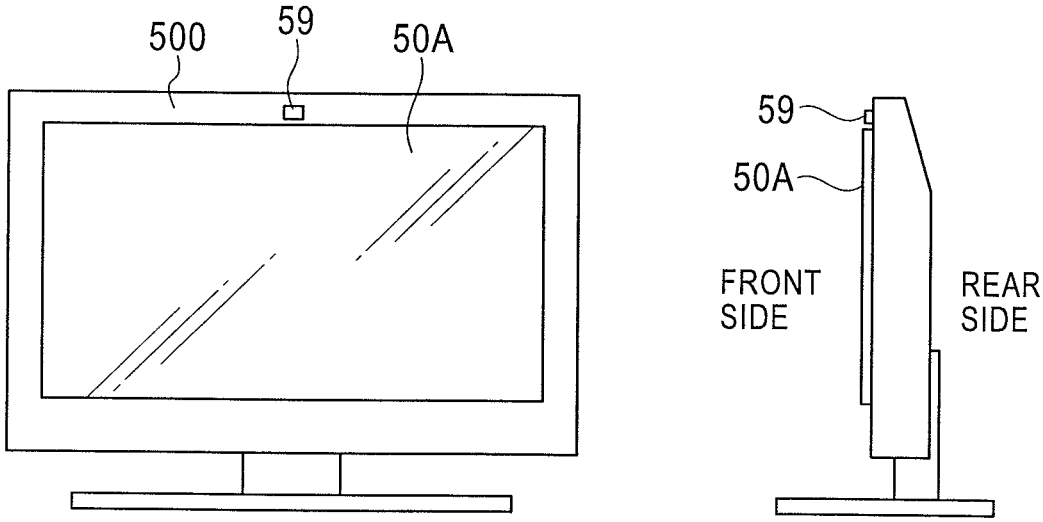
FIG. 25 is a diagram showing an example of an arranging position of an external light sensor 59 shown in FIG. 24.

For example, as shown in FIG. 25, the external light sensor 59 is arranged in a peripheral portion of a display screen 50A of the plasma display apparatus main body, that is, on the surface of a display screen frame 500. The external light sensor 59 detects a brightness (hereinbelow, referred to as external light illuminance) of a space where the plasma display apparatus has been disposed and supplies external light illuminance data LD showing the external light illuminance to the drive control circuit 562. It is assumed that an influence of the light emitted from the display screen of the plasma display apparatus is not included in the external light illuminance.

In a manner similar to the drive control circuit 56, the drive control circuit 562 converts the input video signal every pixel into the 8-bit pixel data in which all luminance levels are expressed by 256 gradations and executes the multi-gradation forming process constructed by the error diffusing process and the dither process to the pixel data, thereby forming the 4-bit multi-gradation pixel data PDs in which all luminance level ranges are expressed by 16 gradations. Subsequently, the drive control circuit 562 converts the multi-gradation pixel data PDs into the pixel drive data GD in accordance with the data conversion table as shown in FIG. 6. The drive control circuit 562 makes the 1st to 14th bits in the pixel drive data GD correspond to the subfields SF1 to SF14, respectively, and supplies the bit digits corresponding to the subfields SF as pixel drive data bits to the address driver 55 every data of one display line (m bits).

The drive control circuit 562 supplies the various kinds of control signals adapted to drive the PDP 50 to the panel driver constructed by the X-electrode driver 51, Y-electrode driver 53, and address driver 55 in accordance with the light-emission driving sequence as shown in FIG. 7. In this instance, the drive control circuit 562 controls the Y-electrode driver 53 in such a manner that the lower the external light illuminance shown by the external light illuminance data LD is, the more the total number of first reset discharges which should be caused per unit time (every Q continuous fields or frames) is reduced.

For example, when the external light illuminance shown by the external light illuminance data LD is higher than a predetermined illuminance C1, the drive control circuit 562 controls the panel driver so as to execute the driving according to the following driving pattern 1. When the external light illuminance shown by the external light illuminance data LD is lower than the illuminance C1 and is higher than a predetermined illuminance C2, the drive control circuit 562 controls the panel driver so as to execute the driving according to the following driving pattern 2 in which the number of occurrence of the first reset discharge per unit period is set to be smaller than that in the driving pattern 1. When the external light illuminance shown by the external light illuminance data LD is lower than the illuminance C2 and is higher than a predetermined illuminance C3, the drive control circuit 562 controls the panel driver so as to execute the driving according to the following driving pattern 3 in which the number of occurrence of the first reset discharge per unit period is set to be smaller than that in the driving pattern 2. When the external light illuminance shown by the external light illuminance data LD is lower than the illuminance C3, the drive control circuit 562 controls the panel driver so as to execute the driving according to the following driving pattern 4 in which the number of occurrence of the first reset discharge per unit period is set to be smaller than that in the driving pattern 3.

Driving pattern 1: The driving according to GTS1 in all fields (frames) and all display lines Driving pattern 2: The driving of every four fields as shown in FIG. 21 is repetitively executed Driving pattern 3: The driving of every two fields as shown in FIG. 22 is repetitively executed Driving pattern 4: The driving of every four fields as shown in FIG. 11 is repetitively executed That is, when the dark contrast is raised, the lower the external light illuminance is, that is, the darker the brightness of regions around the plasma display apparatus is, the higher the effect of improvement of the picture quality which is sensed by the viewer is. The lower the external light illuminance is, therefore, the more the number of first reset discharges to be thinned out is increased.

Figure 26:
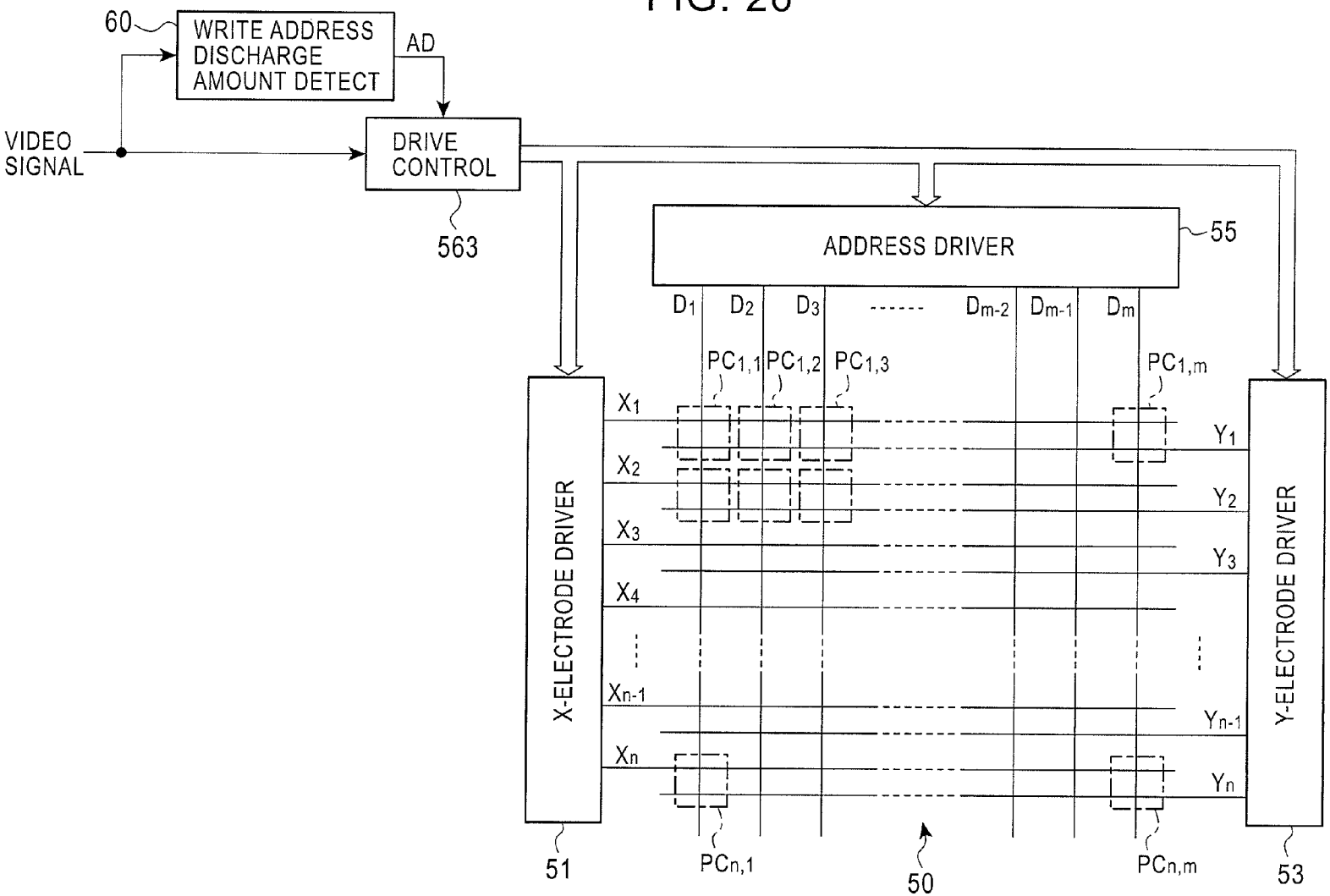
FIG. 26 is a diagram showing a schematic construction of a plasma display apparatus according to an embodiment 5 of the invention.

FIG. 26 is a diagram showing another construction of a plasma display apparatus for driving a plasma display panel according to the driving method of the plasma display panel according to the invention.

Other constructions of the plasma display apparatus shown in FIG. 26 excluding a point that a drive control circuit 563 is used in place of the drive control circuit 56 and a write address discharge amount detecting circuit 60 is newly provided are substantially the same as those shown in FIG. 1. The operations of the write address discharge amount detecting circuit 60 and the drive control circuit 563, therefore, will be mainly described hereinbelow.

The write address discharge amount detecting circuit 60 detects the total number of discharge cells PC, as a write address discharge amount, in which the selective write address discharge is caused in the second selective write addressing step $W2_W$ of the subfield SF2 shown in FIG. 7 on the basis of the input video signal and supplies write address discharge amount data AD showing the write address discharge amount to the drive control circuit 563.

In a manner similar to the drive control circuit 56, the drive control circuit 563 converts the input video signal every pixel into the 8-bit pixel data in which all luminance levels are expressed by 256 gradations and executes the multi-gradation forming process constructed by the error diffusing process and the dither process to the pixel data, thereby forming the 4-bit multi-gradation pixel data PDs in which all luminance level ranges are expressed by 16 gradations. Subsequently, the drive control circuit 563 converts the multi-gradation pixel data PDs into the pixel drive data GD in accordance with the data conversion table as shown in FIG. 6. The drive control circuit 563 makes the 1st to 14th bits in the pixel drive data GD correspond to the subfields SF1 to SF14, respectively, and supplies the bit digits corresponding to the subfields SF as pixel drive data bits to the address driver 55 every data of one display line (m bits).

In a manner similar to the drive control circuit 56, the drive control circuit 563 supplies the various kinds of control signals adapted to drive the PDP 50 to the panel driver constructed by the X-electrode driver 51, Y-electrode driver 53, and address driver 55 in accordance with the light-emission driving sequence as shown in FIG. 7. In this instance, the drive control circuit 563 controls the Y-electrode driver 53 in such a manner that the smaller the write address discharge amount shown by the write address discharge amount data AD is, the more the total number of first reset discharges which should be caused per unit time (every Q continuous fields or frames) is reduced.

For example, when the write address discharge amount shown by the write address discharge amount data AD is larger than a predetermined discharge amount F1, the drive control circuit 563 controls the panel driver so as to execute the driving according to the following driving pattern 1. When the write address discharge amount shown by the write address discharge amount data AD is smaller than the discharge amount F1 and is larger than a predetermined discharge amount F2, the drive control circuit 563 controls the panel driver so as to execute the driving according to the following driving pattern 2 in which the number of occurrence of the first reset discharge per unit period is set to be smaller than that in the driving pattern 1. When the write address discharge amount shown by the write address discharge amount data AD is smaller than the discharge amount F2 and is larger than a predetermined discharge amount F3, the drive control circuit 563 controls the panel driver so as to execute the driving according to the following driving pattern 3 in which the number of occurrence of the first reset discharge per unit period is set to be smaller than that in the driving pattern 2. When the write address discharge amount shown by the write address discharge amount data AD is smaller than the discharge amount F3, the drive control circuit 563 controls the panel driver so as to execute the driving according to the following driving pattern 4 in which the number of occurrence of the first reset discharge per unit period is set to be smaller than that in the driving pattern 3.

Driving pattern 1: The driving according to GTS1 in all fields (frames) and all display lines Driving pattern 2: The driving of every four fields as shown in FIG. 21 is repetitively executed Driving pattern 3: The driving of every two fields as shown in FIG. 22 is repetitively executed Driving pattern 4: The driving of every four fields as shown in FIG. 11 is repetitively executed That is, when the number of discharge cells PC in which the selective write address discharge should be caused in the second selective write addressing step $W2_W$ of the subfield SF2 is large, an amount of current which simultaneously flows into the PDP 50 in association with the discharge increases. In association with the sudden increase in current amount, therefore, the pulse waveform of the pixel data pulse DP which is applied to each column electrode D is deformed and the selective write address discharge is not certainly caused. The more the number of discharge cells PC in which the selective write address discharge should be caused, that is, the more an amount of load due to the selective write address discharge is, the more the total number of first reset discharges which is thinned out is reduced, thereby increasing the amount of priming particles which are formed and stabilizing the selective write address discharge.

Figure 27:
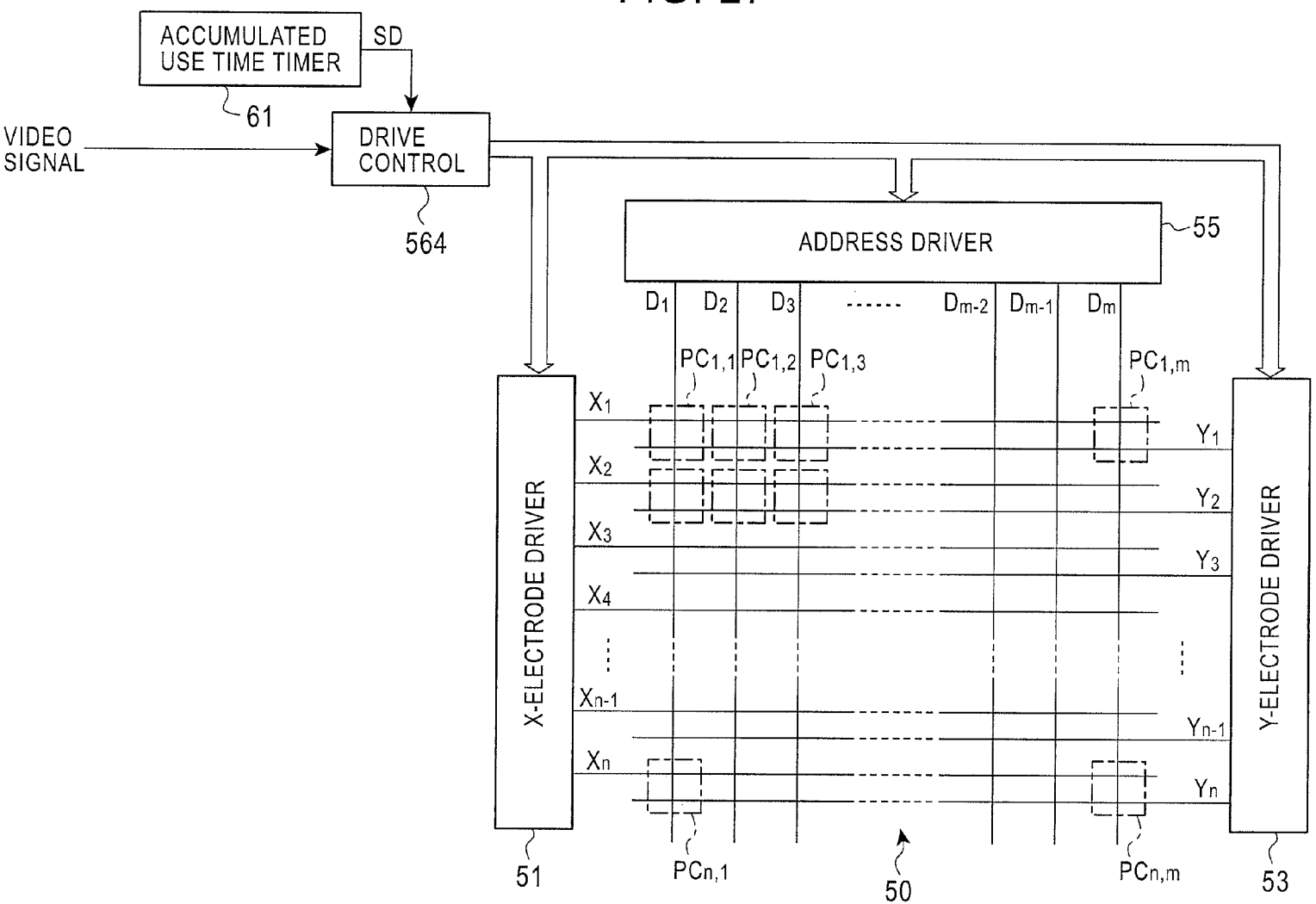
FIG. 27 is a diagram showing a schematic construction of a plasma display apparatus according to an embodiment 6 of the invention.

FIG. 27 is a diagram showing another construction of a plasma display apparatus for driving a plasma display panel according to the driving method of the plasma display panel according to the invention.

Other constructions of the plasma display apparatus shown in FIG. 27 excluding a point that a drive control circuit 564 is used in place of the drive control circuit 56 and an accumulated use time timer 61 is newly provided are substantially the same as those shown in FIG. 1. The operations of the accumulated use time timer 61 and the drive control circuit 564, therefore, will be mainly described hereinbelow.

The accumulated use time timer 61 starts a time measurement in response to the first turn-on of the power source after the shipping from the factory in the plasma display apparatus and temporarily stops the time measuring operation in accordance with the turn-off of the power source. In this instance, the accumulated use time timer 61 stores the elapsed time at the timing of each turn-off of the power source into a built-in register (not shown) as an initial value at the time of the next turn-on of the power source. That is, in accordance with the next power-on, the accumulated use time timer 61 starts counting of the elapsed time from the initial value stored in the built-in register, thereby counting the accumulated use time after the shipping from the factory. At this time, the accumulated use time timer 61 supplies accumulated use time data SD showing the accumulated use time at the present point of time to the drive control circuit 564.

In a manner similar to the drive control circuit 56, the drive control circuit 564 converts the input video signal every pixel into the 8-bit pixel data in which all luminance levels are expressed by 256 gradations and executes the multi-gradation forming process constructed by the error diffusing process and the dither process to the pixel data, thereby forming the 4-bit multi-gradation pixel data PDs in which all luminance level ranges are expressed by 16 gradations. Subsequently, the drive control circuit 564 converts the multi-gradation pixel data PDs into the pixel drive data GD in accordance with the data conversion table as shown in FIG. 6. The drive control circuit 564 makes the 1st to 14th bits in the pixel drive data GD correspond to the subfields SF1 to SF14, respectively, and supplies the bit digits corresponding to the subfields SF as pixel drive data bits to the address driver 55 every data of one display line (m bits).

In a manner similar to the drive control circuit 56, the drive control circuit 564 supplies the various kinds of control signals adapted to drive the PDP 50 to the panel driver constructed by the X-electrode driver 51, Y-electrode driver 53, and address driver 55 in accordance with the light-emission driving sequence as shown in FIG. 7. In this instance, the drive control circuit 564 controls the Y-electrode driver 53 in such a manner that the longer the accumulated use time shown by the accumulated use time data SD is, the more the total number of first reset discharges which should be caused per unit time (every Q continuous fields or frames) is increased.

For example, when the accumulated use time shown by the accumulated use time data SD is longer than a predetermined period T1, the drive control circuit 564 controls the panel driver so as to execute the driving according to the following driving pattern 1. When the accumulated use time shown by the accumulated use time data SD is shorter than the period T1 and is longer than a predetermined period T2, the drive control circuit 564 controls the panel driver so as to execute the driving according to the following driving pattern 2 in which the number of occurrence of the first reset discharge per unit period is set to be smaller than that in the driving pattern 1. When the accumulated use time shown by the accumulated use time data SD is shorter than the period T2 and is longer than a predetermined period T3, the drive control circuit 564 controls the panel driver so as to execute the driving according to the following driving pattern 3 in which the number of occurrence of the first reset discharge per unit period is set to be smaller than that in the driving pattern 2. When the accumulated use time shown by the accumulated use time data SD is shorter than the period T3, the drive control circuit 564 controls the panel driver so as to execute the driving according to the following driving pattern 4 in which the number of occurrence of the first reset discharge per unit period is set to be smaller than that in the driving pattern 3.

Driving pattern 1: The driving according to GTS1 in all fields (frames) and all display lines Driving pattern 2: The driving of every four fields as shown in FIG. 21 is repetitively executed Driving pattern 3: The driving of every two fields as shown in FIG. 22 is repetitively executed Driving pattern 4: The driving of every four fields as shown in FIG. 11 is repetitively executed That is, the longer the accumulated use time in the PDP 50 is, the more the discharging characteristics of the panel change and the selective write address discharge which should be caused in the second selective write addressing step W2, of SF2 becomes unstable and a write error is liable to occur. The longer the accumulated use time is, the more the number of first reset discharges which are thinned out is reduced, thereby increasing the amount of priming particles which are formed and stabilizing the selective write address discharge.

Figure 28:
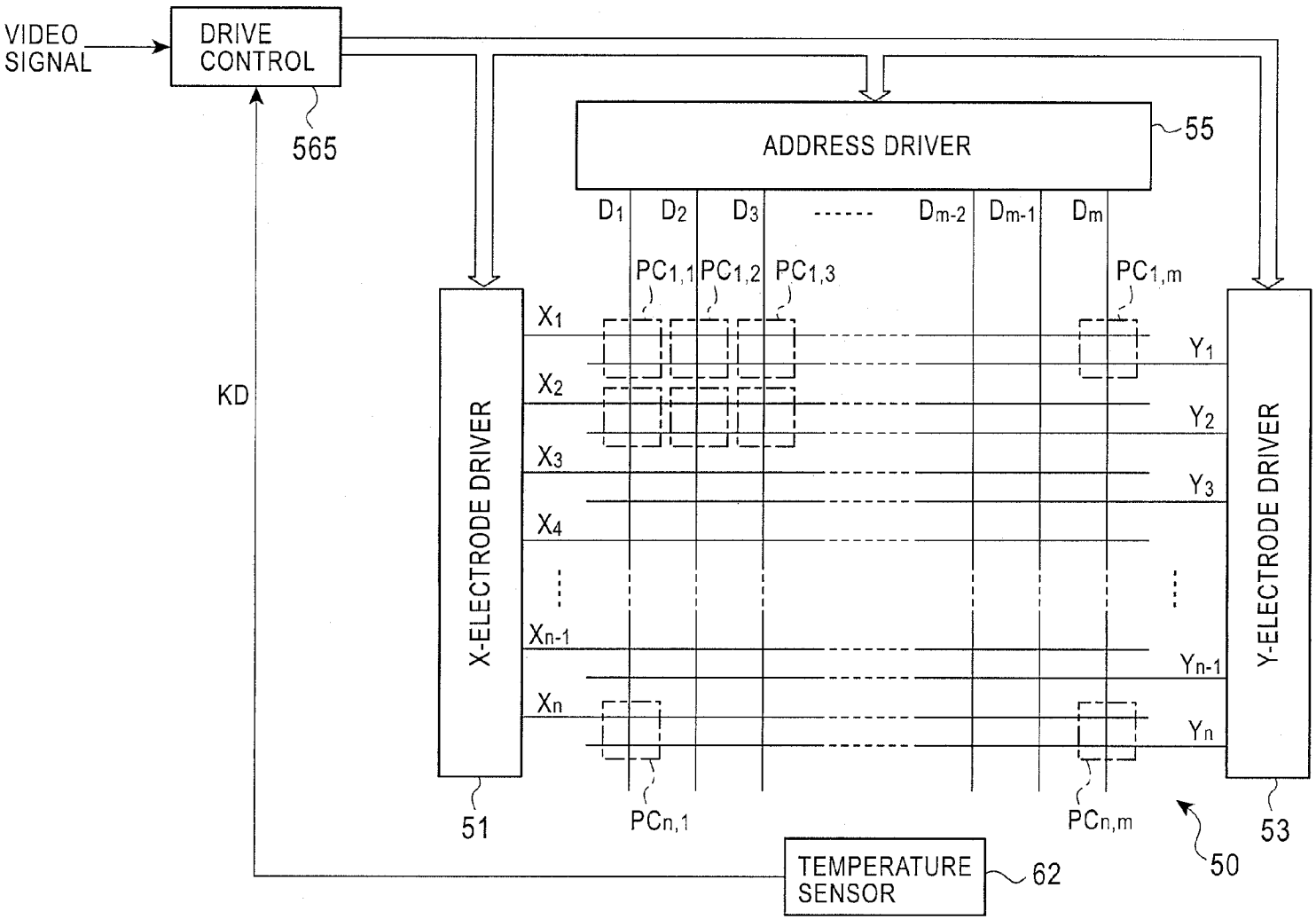
FIG. 28 is a diagram showing a schematic construction of a plasma display apparatus according to an embodiment 7 of the invention.

FIG. 28 is a diagram showing another construction of a plasma display apparatus for driving a plasma display panel according to the driving method of the plasma display panel according to the invention.

Other constructions of the plasma display apparatus shown in FIG. 28 excluding a point that a drive control circuit 565 is used in place of the drive control circuit 56 and a temperature sensor 62 is newly provided are substantially the same as those shown in FIG. 1. The operations of the temperature sensor 62 and the drive control circuit 565, therefore, will be mainly described hereinbelow.

The temperature sensor 62 measures a temperature of the PDP 50 (for example, a temperature of the front transparent substrate 10 or the rear substrate 14) or a temperature of a region around the PDP 50 and supplies temperature data KD showing the measured temperature to the drive control circuit 565.

In a manner similar to the drive control circuit 56, the drive control circuit 565 converts the input video signal every pixel into the 8-bit pixel data in which all luminance levels are expressed by 256 gradations and executes the multi-gradation forming process constructed by the error diffusing process and the dither process to the pixel data, thereby forming the 4-bit multi-gradation pixel data PDs in which all luminance level ranges are expressed by 16 gradations. Subsequently, the drive control circuit 565 converts the multi-gradation pixel data PDs into the pixel drive data GD in accordance with the data conversion table as shown in FIG. 6. The drive control circuit 565 makes the 1st to 14th bits in the pixel drive data GD correspond to the subfields SF1 to SF14, respectively, and supplies the bit digits corresponding to the subfields SF as pixel drive data bits to the address driver 55 every data of one display line (m bits).

In a manner similar to the drive control circuit 56, the drive control circuit 565 supplies the various kinds of control signals adapted to drive the PDP 50 to the panel driver constructed by the X-electrode driver 51, Y-electrode driver 53, and address driver 55 in accordance with the light-emission driving sequence as shown in FIG. 7. In this instance, the drive control circuit 565 controls the Y-electrode driver 53 in such a manner that the larger a fluctuation width of the temperature shown by the temperature data KD from a predetermined temperature is, that is, the larger a temperature difference is, the more the total number of first reset discharges which should be caused per unit time (every Q continuous fields or frames) is increased.

For example, when the temperature difference of the temperature shown by the temperature data KD from the predetermined temperature is larger than a predetermined temperature difference Q1, the drive control circuit 565 controls the panel driver so as to execute the driving according to the following driving pattern 1. When the temperature difference of the temperature shown by the temperature data KD from the predetermined temperature is smaller than the temperature difference Q1 and is larger than a predetermined temperature difference Q2, the drive control circuit 565 controls the panel driver so as to execute the driving according to the following driving pattern 2 in which the number of occurrence of the first reset discharge per unit period is set to be smaller than that in the driving pattern 1. When the temperature difference of the temperature shown by the temperature data KD from the predetermined temperature is smaller than the temperature difference Q2 and is larger than a predetermined temperature difference Q3, the drive control circuit 565 controls the panel driver so as to execute the driving according to the following driving pattern 3 in which the number of occurrence of the first reset discharge per unit period is set to be smaller than that in the driving pattern 2. When the temperature difference of the temperature shown by the temperature data KD from the predetermined temperature is smaller than the temperature difference Q3, the drive control circuit 565 controls the panel driver so as to execute the driving according to the following driving pattern 4 in which the number of occurrence of the first reset discharge per unit period is set to be smaller than that in the driving pattern 3.

Figure 29:
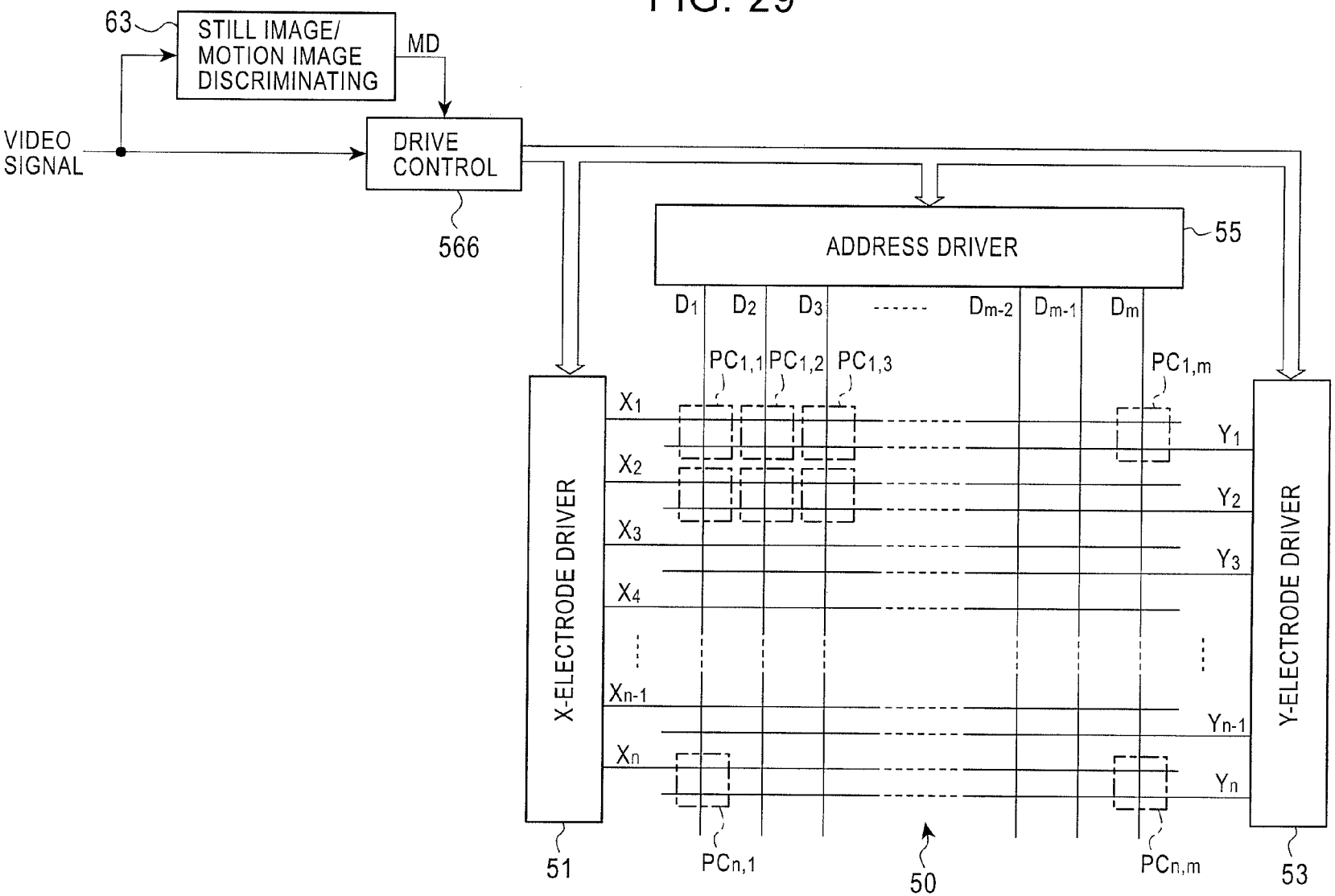
FIG. 29 is a diagram showing a schematic construction of a plasma display apparatus according to an embodiment 8 of the invention.

Driving pattern 1: The driving according to GTS1 in all fields (frames) and all display lines Driving pattern 2: The driving of every four fields as shown in FIG. 21 is repetitively executed Driving pattern 3: The driving of every two fields as shown in FIG. 22 is repetitively executed Driving pattern 4: The driving of every four fields as shown in FIG. 11 is repetitively executed That is, when the temperature of the PDP 50 fluctuates, the discharging characteristics of the panel change in association with the temperature fluctuation, the selective write address discharge which should be caused in the second selective write addressing step W2, of SF2 becomes unstable, and the write error is liable to occur. The larger a width of the temperature fluctuation (temperature difference) is, the more the number of first reset discharges which are thinned out is reduced, thereby increasing the amount of priming particles which are formed and stabilizing the selective write address discharge. FIG. 29 is a diagram showing another construction of a plasma display apparatus for driving a plasma display panel according to the driving method of the plasma display panel according to the invention.

Other constructions of the plasma display apparatus shown in FIG. 29 excluding a point that a drive control circuit 566 is used in place of the drive control circuit 56 and a still image/motion image discriminating circuit 63 is newly provided are substantially the same as those shown in FIG. 1. The operations of the still image/motion image discriminating circuit 63 and the drive control circuit 566, therefore, will be mainly described hereinbelow.

On the basis of each of the continuous fields in the input video signal, the still image/motion image discriminating circuit 63 discriminates whether or not the image formed by the input video signal is a still image or a motion image, and supplies still image/motion image discrimination data MD showing a result of the discrimination to the drive control circuit 566.

In a manner similar to the drive control circuit 56, the drive control circuit 566 converts the input video signal every pixel into the 8-bit pixel data in which all luminance levels are expressed by 256 gradations and executes the multi-gradation forming process constructed by the error diffusing process and the dither process to the pixel data, thereby forming the 4-bit multi-gradation pixel data PDs in which all luminance level ranges are expressed by 16 gradations. Subsequently, the drive control circuit 566 converts the multi-gradation pixel data PDs into the pixel drive data GD in accordance with the data conversion table as shown in FIG. 6. The drive control circuit 566 makes the 1st to 14th bits in the pixel drive data GD correspond to the subfields SF1 to SF14, respectively, and supplies the bit digits corresponding to the subfields SF as pixel drive data bits to the address driver 55 every data of one display line (m bits).

In a manner similar to the drive control circuit 56, the drive control circuit 566 supplies the various kinds of control signals adapted to drive the PDP 50 to the panel driver constructed by the X-electrode driver 51, Y-electrode driver 53, and address driver 55 in accordance with the light-emission driving sequence as shown in FIG. 7. In this instance, the drive control circuit 566 controls the Y-electrode driver 53 in such a manner that if it is determined by the still image/motion image discrimination data MD that the image form of the input video signal indicates the still image, the total number of first reset discharges which should be caused per unit time (every Q continuous fields or frames) is reduced as compared with that in the case where it is decided that the image form indicates the motion image.

For example, if it is determined on the basis of the still image/motion image discrimination data MD that the image form of the input video signal indicates the still image, the drive control circuit 566 controls the panel driver according to the second driving pulse applying sequence GTS2 (shown in FIG. 9) or the third driving pulse applying sequence GTS3 (shown in FIG. 10) in which no first reset discharge is caused for all of the fields and all of the display lines. If it is decided that the image form of the input video signal indicates the motion image, the drive control circuit 566 controls the panel driver so as to execute the driving as shown in FIG. 11, 14, 15, 21, or 22. When it is decided that the image form of the input video signal indicates the still image, if the total number of first reset discharges which should be caused per unit time is smaller than that in the case where it is decided that the image form indicates the motion image, the driving as shown in one of FIGS. 11, 14, 15, 21, and 22 may be executed.

That is, in the case of the still image display, since the discharge cell PC for performing the black display also performs the black display in the next field, it is unnecessary to cause the selective write address discharge in the second selective write addressing step $W2_W$ of SF2 with respect to the discharge cell PC. In the case of the discharge cell PC for performing the non-black display, since the sustain discharge has been caused in the field just before it, the discharge cell PC is in a state where a relatively large number of priming particles exist and the selective write address discharge is certainly caused. In the case, even if the first reset discharge is not caused in all of the discharge cells PC, a relatively large number of priming particles remain in the discharge cell PC in which the selective write address discharge should be caused. Even if the first reset discharge is omitted, therefore, the selective write address discharge can be certainly caused. In the case, consequently, no first reset discharge is caused in all of the discharge cells PC, thereby further improving the dark contrast. This application is based on a Japanese patent application No. 2008-052275 which is hereby incorporated by reference.

What is claimed is:

1. A method for driving a plasma display panel in accordance with pixel data based on a video signal, in which plasma display panel is constructed in such a manner that a first substrate and a second substrate are arranged so as to face each other through a discharge space in which a discharge gas has been sealed, a discharge cell is formed in each of cross portions of a plurality of row electrode pairs formed on said first substrate, each of said row electrode pairs is composed of a first row electrode and a second row electrode, and a plurality of column electrodes formed on said second substrate, and said panel has a phosphor layer containing a phosphor material formed on a surface of each of said discharge cells which are in contact with said discharge space and the driving method comprises:

executing an addressing step of applying a scanning pulse to each of the first row electrodes and a sustaining step in each of a plurality of subfields every unit display period which is one frame display period or one field display period in said video signal and executing a resetting step of applying a reset pulse to each of said first row electrodes in one of said subfields prior to said addressing step;

in said resetting step of said one of said subfields in a first one of said unit display periods, applying the reset pulse having a first peak electric potential to one of said first row electrodes and applying the reset pulse having a second peak electric potential lower than said first peak electric potential to remaining ones of said first row electrodes; and in said resetting step of said one of said subfields in a second unit display period subsequent to said first unit display period, applying the reset pulse having a third peak electric potential lower than said first peak electric potential to all of said first row electrodes.

2. A method according to claim 1, wherein in a third unit display period subsequent to said second unit display period, in said resetting step, the peak electric potential of said reset pulse which is applied to said one of said first row electrodes is set to said second peak electric potential and the peak electric potential of said reset pulse which is applied to the remaining ones of said first row electrodes is set to said first peak electric potential.

3. A method according to claim 1, wherein in said resetting step, a first reset pulse having said first peak electric potential is applied, a second reset pulse having said second peak electric potential is applied, and a third reset pulse having said third peak electric potential is applied.

4. A method according to claim 2, wherein in said resetting step, a first reset pulse having said first peak electric potential is applied, a second reset pulse having said second peak electric potential is applied, and a third reset pulse having said third peak electric potential is applied.

5. A method according to claim 3, wherein:

said one of said first row electrodes is included in a first group in all of said first row electrodes and the remaining ones of said first row electrodes is included in a second group in all of said first row electrodes;

in said resetting step in said first unit display period, said first reset pulse is applied to each of the first row electrodes in said first group and said second reset pulse is applied to each of the first row electrodes in said second group; and in said resetting step in said second unit display period, said third reset pulse is applied to all of said first row electrodes.

6. A method according to claim 4, wherein:

said one of said first row electrodes is included in a first group in all of said first row electrodes and the remaining ones of said first row electrodes is included in a second group in all of said first row electrodes;

in said resetting step in said first unit display period, said first reset pulse is applied to each of the first row electrodes in said first group and said second reset pulse is applied to each of the first row electrodes in said second group; and in said resetting step in said second unit display period, said third reset pulse is applied to all of said first row electrodes.

7. A method according to claim 5, wherein in said resetting step in a third unit display period subsequent to said second unit display period, said second reset pulse is applied to each of the first row electrodes in said first group and said first reset pulse is applied to each of the first row electrodes in said second group.

8. A method according to claim 6, wherein in said resetting step in a third unit display period subsequent to said second unit display period, said second reset pulse is applied to each of the first row electrodes in said first group and said first reset pulse is applied to each of the first row electrodes in said second group.

9. A method according to claim 1, wherein said first peak electric potential is a voltage value which is equal to or larger than a discharge start voltage between the first row electrode and said column electrode and both of said second peak electric potential and said third peak electric potential are less than said discharge start voltage.

10. A method according to claim 7, wherein said first group includes the row electrodes belonging to a (2n−1)th (n: natural number) display line and said second group includes the row electrodes belonging to a 2n-th display line.

11. A method according to claim 8, wherein said first group includes the row electrodes belonging to a (2n−1)th (n: natural number) display line and said second group includes the row electrodes belonging to a 2n-th display line.

12. A method according to claim 7, wherein said first group includes the row electrodes belonging to a 3n-th (n: natural number) display line and said second group includes the row electrodes belonging to a (3n−2)th or (3n−1)th display line.

13. A method according to claim 8, wherein said first group includes the row electrodes belonging to a 3n-th (n: natural number) display line and said second group includes the row electrodes belonging to a (3n−2)th or (3n−1)th display line.

14. A method according to claim 7, wherein said first group includes the row electrodes belonging to (4n−3)th and (4n−2)th (n: natural number) display lines and said second group includes the row electrodes belonging to (4n−1)th and 4n-th display lines.

15. A method according to claim 8, wherein said first group includes the row electrodes belonging to (4n−3)th and (4n−2)th (n: natural number) display lines and said second group includes the row electrodes belonging to (4n−1)th and 4n-th display lines.

16. A method according to claim 1, wherein a secondary electron emitting material is contained in said phosphor layer.

17. A method according to claim 16, wherein said secondary electron emitting material is a magnesium oxide and said magnesium oxide contains a magnesium oxide crystal which is excited by an electron beam and executes a cathode luminescence light emission having a peak within a wavelength range of 200 to 300 nm.

18. A method according to claim 17, wherein a particle diameter of said magnesium oxide crystal is equal to or larger than 2000 Å.

* * * * *